US007722415B2

(12) United States Patent
Chansrivong

(10) Patent No.: US 7,722,415 B2
(45) Date of Patent: May 25, 2010

(54) IN-LINE CONNECTOR

(75) Inventor: Derek Chansrivong, Foothill Ranch, CA (US)

(73) Assignee: Bal Seal Engineering, Inc., Foothill Ranch, CA (US)

( * ) Notice: Subject to any disclaimer, the term of this patent is extended or adjusted under 35 U.S.C. 154(b) by 0 days.

(21) Appl. No.: 12/329,870

(22) Filed: Dec. 8, 2008

(65) Prior Publication Data

US 2009/0149053 A1 Jun. 11, 2009

Related U.S. Application Data

(60) Provisional application No. 60/992,968, filed on Dec. 6, 2007.

(51) Int. Cl.
*H01R 24/04* (2006.01)

(52) U.S. Cl. ..... 439/840; 439/827; 439/788

(58) Field of Classification Search ..... 439/840, 439/827, 788, 786, 787, 825, 843, 851, 860
See application file for complete search history.

(56) References Cited

U.S. PATENT DOCUMENTS

| | | | | |
|---|---|---|---|---|
| 4,033,654 | A * | 7/1977 | Ross | 439/607.17 |
| 4,072,154 | A | 2/1978 | Anderson et al. | |
| 4,105,037 | A | 8/1978 | Richter et al. | |
| 4,202,592 | A | 5/1980 | Rullier et al. | |
| 4,262,673 | A | 4/1981 | Kinney et al. | |
| 4,461,194 | A | 7/1984 | Moore | |
| 4,462,657 | A * | 7/1984 | Snowdon et al. | 439/840 |
| 4,810,213 | A * | 3/1989 | Chabot | 439/825 |
| 4,824,400 | A | 4/1989 | Spinner | |
| 4,934,366 | A | 6/1990 | Truex et al. | |
| 4,995,832 | A | 2/1991 | Thommen | |
| 5,263,878 | A * | 11/1993 | Lai | 439/656 |
| 5,413,595 | A | 5/1995 | Stutz, Jr. | |
| 5,545,842 | A * | 8/1996 | Balsells | 174/372 |
| 5,817,984 | A | 10/1998 | Taylor et al. | |
| 5,866,851 | A | 2/1999 | Taylor et al. | |
| 5,938,474 | A | 8/1999 | Nelson | |
| 6,029,089 | A | 2/2000 | Hawkins et al. | |
| 6,192,277 | B1 | 2/2001 | Lim et al. | |

(Continued)

FOREIGN PATENT DOCUMENTS

KR 20-2007-0000534 U 5/2007

OTHER PUBLICATIONS

International Search Report from corresponding International Application No. PCT/US2008/085919, filed Dec. 8, 2008 (3 pages).

(Continued)

*Primary Examiner*—Gary F. Paumen
(74) *Attorney, Agent, or Firm*—Klein, O'Neill & Singh, LLP

(57) ABSTRACT

Connectors are provided herein for connecting two elongated members that are positioned in-line to one another. Advantageously, the connectors not only allow for connection of the two members to permit for mechanical, electrical, EMI, and/or grounding applications, the connectors have provisions for accommodating thermal expansion and offset, which may include angular and/or axial offset. In certain embodiments, one or more collapsible housing pins or collars are provided to permit assembly and disassembly by either extending the housing pin or collapsing the housing pin.

20 Claims, 18 Drawing Sheets

U.S. PATENT DOCUMENTS 6,428,368 B1 8/2002 Hawkins et al.
6,498,952 B2 12/2002 Imani et al.
6,671,554 B2 12/2003 Gibson et al.
6,749,358 B2 * 6/2004 Balsells ..... 403/316
6,755,694 B2 6/2004 Ries et al.
6,879,857 B2 4/2005 Swanson et al.
6,895,276 B2 5/2005 Kast et al.
7,003,351 B2 2/2006 Tvaska et al.
7,047,077 B2 5/2006 Hansen et al.
7,062,329 B2 6/2006 Ostroff
7,063,563 B1 6/2006 Hsu
7,070,455 B2 7/2006 Balsells
7,083,474 B1 8/2006 Fleck et al.
7,108,549 B2 9/2006 Lyu et al.
7,164,951 B2 1/2007 Ries et al.
7,187,974 B2 3/2007 Haeg et al.
7,195,523 B2 3/2007 Naviaux
7,241,180 B1 7/2007 Torres
7,263,401 B2 8/2007 Scott et al.
7,299,095 B1 11/2007 Barlow et al.
7,303,422 B2 12/2007 Hoffer et al.
7,316,593 B2 * 1/2008 Balsells ..... 439/827
7,326,083 B2 2/2008 Mehdizadeh et al.
7,429,199 B2 9/2008 Burgess

OTHER PUBLICATIONS

Written Opinion from corresponding International Application No. PCT/US2008/085919, filed Dec. 8, 2008 (5 pages).

* cited by examiner

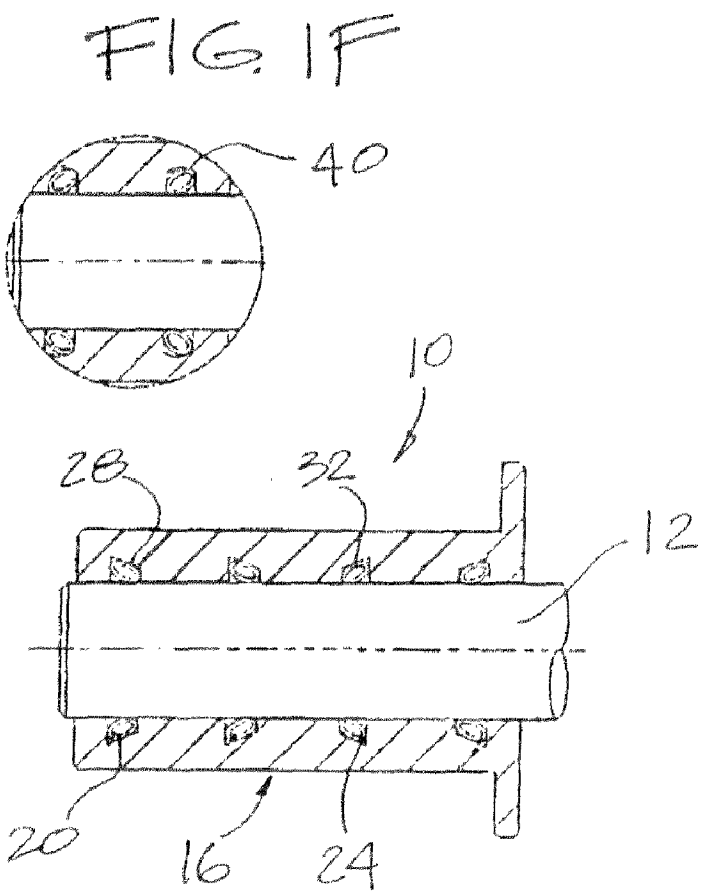
FIG. 1B
FIG. 1F
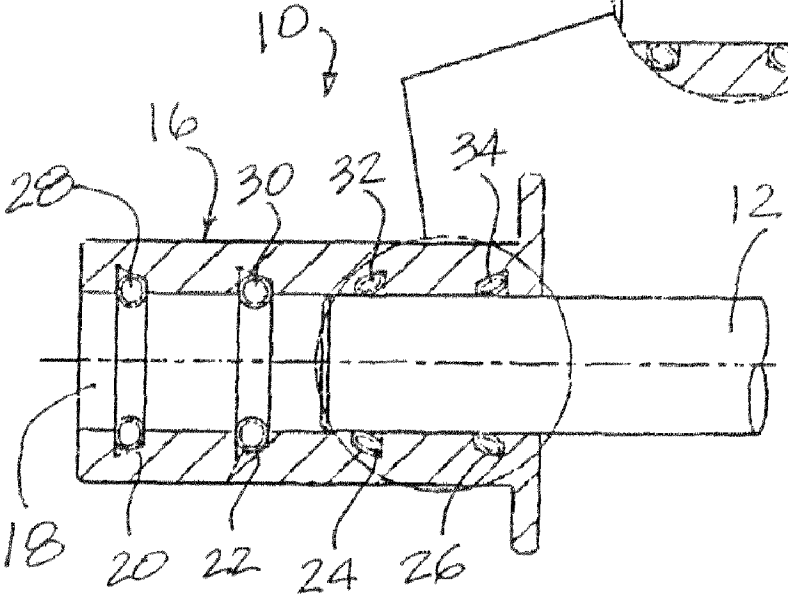
FIG. 1A
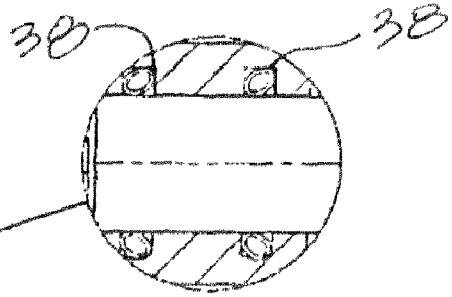
FIG. 1E

IN-LINE CONNECTOR

CROSS-REFERENCED TO RELATED APPLICATION

This is an ordinary application of Provisional Application No. 60/992,968, filed Dec. 6, 2007. The contents of the '968 provisional application are expressly incorporated herein by reference for all purposes.

BACKGROUND

In-line mechanical, electrical, electromagnetic interference (EMI), and grounding connectors using canted coil springs offer significant advantages in applications requiring the mechanical, electrical, EMI, or grounding connection of two elongated members or rods that are subjected to vibration, to extreme and highly variable temperatures, and that require a high degree of reliability. The rods are usually, although not required, cylindrical in configuration.

At extreme and highly variable temperatures, connected conductive members, such as rods, may undergo thermal expansion. Often conductive bars are adjacent to high speed or rotating applications, such as generators and motors, and, as such, may experience intense vibration. Under such conditions, typical means of mechanical connection such as screw/threaded, hinged, and other jointed connections are limited to the amount of thermal expansion and vibration they can withstand and still perform sufficiently. Additionally, when components of connectors are made from different materials, such as copper and steel, a difference in thermal expansion between the two materials at high and variable temperatures often causes failure in such connectors since the greater expansion of one component can damage another component or result in loss of contact between components. When screw/thread connectors are used, the variable thermal variation of the threaded components can cause the threaded portions to disengage from each other, and, in electrical applications, can increase the current resistance of electrical conductors, thus decreasing their current carrying capabilities.

SUMMARY

The use of canted-coil spring-loaded connectors may overcome limitations of conventional connection means. Canted-coil springs in connectors provide substantially constant contact force over a wide range of deflection when using radial canted-coil springs or variable contact force when using axial canted-coil springs, thereby tolerating differences in thermal expansions from wide temperature variations and retaining constant or variable force connections between members experiencing high speeds and intense vibration. Canted-coil spring loaded connectors can tolerate wide variations in misalignment since canted-coil springs can maintain constant contact during in-line axial, radial and angular offsets over an operating deflection range of the springs. The use of canted-coil springs in conjunction with tool-less housings, such as holding, latching, or locking means, allows for easy tool-less assembly and connection of canted-coil spring-loaded connectors and cylindrical conductive members. However, mechanical fasteners, such as threaded screws or lock nuts, may be used in combination with spring-based connectors.

Canted-coil spring loaded connectors can provide connection for in-line butted or in-line separated cylindrical members in mechanical, electrical, EMI, or grounding applications using conductive materials, and can comprise either a single moveable component, or numerous moveable components that allow the connector to be collapsible. Collapsible tool-less connector allow the connector to be compressed into a small package and to be assembled onto cylindrical members in tight and difficult to reach spaces or from awkward positions. Collapsible tool-less connectors may also be used when members to be connected are fixed and a space between members cannot be adjusted.

Examples of applications of canted-coil spring loaded in-line collapsible electrical connectors include space applications where awkward positions and the absence of gravity make the installation or repair of electrical connectors difficult, especially in cases where multiple parts and tools are required. For example, astronauts assembling external spacecraft instruments and equipment may have difficulty handling numerous parts and tools. Other examples where tool-less canted-coil spring loaded collapsible connectors may be used include switch gear or bus bar connections in nuclear power plants since, in some areas, it may not be possible to bring tools into said areas as they can become contaminated. In solar energy applications, the electrical connectors used are replaced frequently in the field, and not by specialized companies, so tool-less connectors would provide a simple connection, quick installation time, and avoid the risk of miss-assembly. Instruments housed in closed quarters, such as instrument panels and switch gears, are also good candidates for the connectors of the present invention. Additionally, canted-coil spring(s) loaded in-line collapsible electrical connectors may be used where physical protection must be worn which may affect handling capabilities, such as in hazardous environments due to chemical exposure, radiation exposure, deep sea pressure, or extreme temperatures.

Canted-coil springs are disclosed in U.S. Pat. Nos. 4,826,144, 4,893,795, 4,876,781, 4,907,788, 4,961,253, 4,934,666, 4,915,366, 5,160,122, 4,964,204, 5,108,078, 5,079,388, 5,139,276, 5,082,390, 5,091,606, 5,161,806, 5,239,737, 5,474,309, 5,545,842, 5,411,348, 5,503,375, 5,599,027, 5,615,870, 5,709,371, 5,791,638, 7,055,812, B2, 6,835,084 B2, and 7,272,964 and are expressly incorporated herein by reference in their entirety. Such canted coil springs may be incorporated into connections having radial, axial, and angular springs with variable spring forces and made from different materials depending on the operating conditions in mechanical applications, electrical applications, or a combination thereof. The canted coil springs may be used to conduct current, and to retain, latch and lock components in mechanical or combination mechanical and electrical applications.

The use of canted-coil spring-loaded mechanical connectors for mechanical, electrical, EMI, grounding connections, or combinations thereof may result in or provide the following non-limiting useful benefits:

1) A connector that requires little or no adjustment during assembly and disassembly.
2) A connector that allows tool-less in-line assembly and disassembly of the connector.
3) A connector that allows in-line axial, radial and/or angular misalignment of the components thus allowing wide variations in temperature and wide variation in tolerances of the components.
4) A secure means to maintain substantially constant mechanical connection between two cylindrical members.

To facilitate the transmission of current, various means, such as cables or threaded adaptors, have been used. However, such means may not be sufficient when ease of assembly and long-term reliability are the main considerations. Cables tend to fray under extreme temperatures and vibration, while adaptors may loosen due to variable thermal expansion of the components.

The use of a collapsible and expandable in-line connector with canted-coil loaded springs results in or provide the following non-limiting useful benefits:

1) A collapsible and expandable in-line connector that is easy to install and repair. To further simply such tasks, the connector optionally does not require tools or adjustment during assembly and disassembly.
2) A collapsible connector that allows in-line assembly, expansion, locking and/or disassembly of the connector.
3) A connector that allows in-line axial, radial and/or angular misalignment of the components, permitting wide variation in temperature and in tolerances of the components.
4) Application of axial canted-coil springs that permit a high degree of conductivity by continually removing, under dynamic conditions, any oxidation formed on the conductors due to environmental causes or variations in temperature.
5) A secure means to maintain constant contact between halves of the conductor and preventing conductor components from slipping and interrupting current flow.

Aspects of the present invention include a tool-less in-line electrical connector comprising a housing having a longitudinal bore and a plurality of grooves spaced along an inner circumferential surface of the longitudinal bore; and a canted-coil spring positioned within each groove, each canted-coil spring dimensioned to contact a conductor pin inserted into the longitudinal bore.

In another aspect of the present invention, there is provided a tool-less in-line electrical connector comprising a housing comprising an outer sleeve defining a sleeve longitudinal bore including a first bore section having a first diameter and a second bore section having a second diameter adapted to receive a conductor pin; and an inner retaining cylinder slidable within the first bore section with respect to the outer sleeve, the first bore section and the second bore section having at least one groove along an inner circumferential surface containing a canted-coil spring; wherein the inner retaining cylinder defines a cylinder longitudinal bore coaxial with the sleeve longitudinal bore having at least one groove along an inner circumferential surface containing a canted-coil spring, the cylinder longitudinal bore adapted to receive a conductor pin. The electrical connector may optionally comprise a retaining groove around an outer circumferential surface of the retaining cylinder adapted to engage the canted-coil spring in the first bore section of the outer sleeve.

In still yet another aspect of the present invention, there is provided a tool-less in-line electrical connector comprising a housing defining a longitudinal bore and a plurality of grooves spaced along an inner circumferential surface of the bore, each groove containing a canted-coil spring; and two connector pins slidable within the longitudinal bore, each connector pin having a base adapted to contact the inner circumferential surface of the housing and a receiving portion having at least one canted-coil spring within an inner circumferential groove, the receiving portion adapted to receive a conductor pin.

In yet another aspect of the present invention, there is provided a tool-less in-line electrical connector comprising a housing defining a longitudinal bore and a plurality of housing grooves spaced along an inner circumferential surface of the bore; and two connector pins slidable within the longitudinal bore, each connector pin including a base having a canted-coil spring within a groove, the canted-coil spring adapted to engage one housing groove, and a receiving portion having at least one canted-coil spring within an inner circumferential groove, the receiving portion dimensioned to receive a conductor pin.

The present invention also includes a method for electrically communicating two conductor pins comprising pushing an end of a first conductor pin into a first bore comprising at least one canted-coil spring; pushing an end of a second conductor pin into a second bore comprising at least one canted coil spring; and sliding a conductor housing relative to either the first conductor pin or the second conductor pin or sliding a sleeve located inside the conductor housing relative to the conductor housing.

These and other features of the present invention may be better understood when the specification is read in view of the drawings below.

BRIEF DESCRIPTION OF THE DRAWINGS

FIGS. 1A, 1B, 1C are cross-sectional side views of an exemplary embodiment of a connector of the present invention during various states of engagement with conductor pins.

FIGS. 1E and 1F are cross-sectional side views of alternate groove configurations of a housing of the connector of FIG. 1 in accordance with exemplary embodiments of the present invention.

FIG. 1G is a detail cross-sectional side view of a groove configuration of a conductor pin in accordance with an exemplary embodiment of the present invention.

FIGS. 1H, 1K, 1L are detail cross-sectional side views of alternate groove configurations of a conductor pin in accordance with exemplary embodiments of the present invention.

DETAILED DESCRIPTION

Figure 1C:
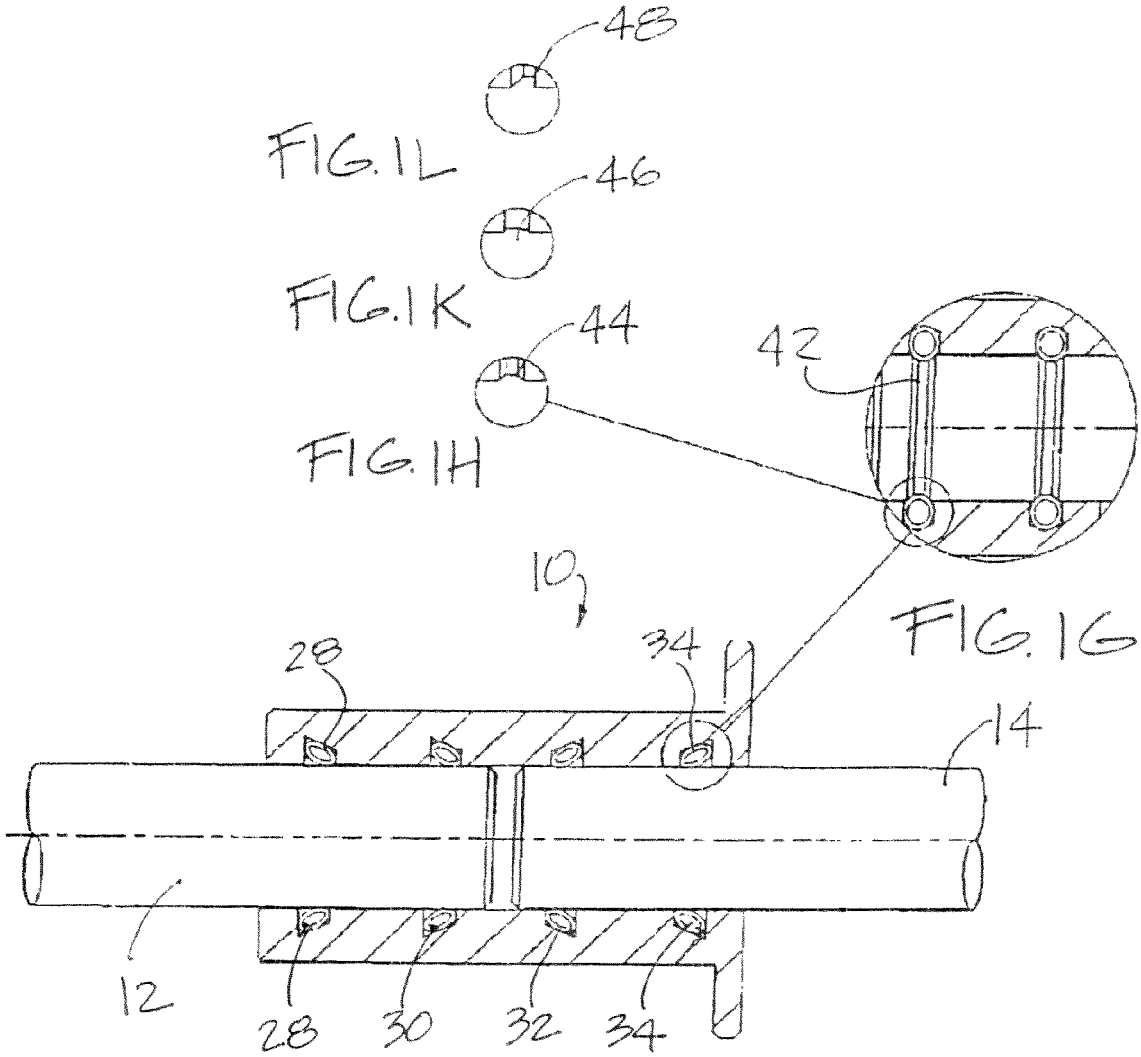

The detailed description set forth below in connection with the appended drawings is intended as a description of the presently preferred embodiments of tool-less connectors provided in accordance with aspects of the present invention and is not intended to represent the only forms in which the present invention may be constructed or utilized. The description sets forth the features and the steps for constructing and using the connectors of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like or similar elements or features.

FIGS. 1A-1M show exemplary embodiments of a connector 10 for connecting unthreaded butted cylindrical members, pins, or rods 12, 14 using biasing members for retention. Such connector permits axial and radial movement to tolerate wide variations in temperature as well as wide dimensional and position tolerances between members. The connector 10 may be used for mechanical, electrical, EMI, and/or grounding applications in which two in-line members are connected and retained together using frictional force, as provided by, for example, canted coil springs. Advantageously, the connector 10 may be used to connect two butted members without a tool. By in-line, what is meant is that two ends of two members may be positioned end to end but not necessarily in contact with one another or in perfect alignment. In other words, the two members may be positioned in-line with one another but offset.

FIG. 1A shows the connector 10 comprising a housing 16 having a longitudinal bore 18. The connector 10 further comprises inner circumferential grooves, such as four grooves 20, 22, 24, 26, for housing biasing members 28, 30, 32, 34, respectively, which are preferably canted coil springs. The grooves 20, 22, 24, and 26 may embody any combination of contours discussed in the various patents incorporated above and as specifically shown in the accompanied figures, such as a tapered bottom groove 36 (FIG. 1D), a flat bottom groove 38 (FIG. 1E), or v-bottom groove 40 (FIG. 1F), to provide different forces in different directions. The canted-coil springs 28, 30, 32, and 34 may be any combination of or any one of radial, axial, and angular canted-coil springs to provide different forces, tolerances, and characteristics of conductivity. Furthermore, for a particular connector, a combination of different grooves (i.e., grooves with different characteristics, such as different bottom configurations) may be used.

With reference to FIG. 1B, the connector 10 is mounted onto the elongated or cylindrical member 12, or the cylindrical member 12 is inserted into the bore 18 of the connector, such that canted-coil springs 28, 30, 32, and 34 are compressed or deflected along a radial direction of each individual coil of the canted-coil springs. The springs thus exert spring forces on the elongated member 12 at spaced apart intervals along the length of the elongated members to retain the elongated member 12 within the bore.

With reference to FIG. 1C, the connector 10 is mounted onto two butted or generally axially aligned cylindrical members 12, 14. The first cylindrical member 12 is held by a first set of canted-coil springs 28, 30 while the second cylindrical member 14 is held by a second set of canted-coil springs 32, 34. In some embodiments, the cylindrical members 12, 14, or one of the two members, may comprise grooves 42 (FIG. 1G) along an exterior circumferential surface to engage the canted-coil springs 28, 30, 32, 34 to retain the cylindrical members within the housing 16. The grooves 42, shown generally in FIG. 1G, may be one of or any combination of a v-bottom groove 44 (FIG 1H), a flat bottom groove 46 (FIG. 1K), or a tapered bottom groove 48, (FIG. 1L), to provide different forces during connection and disconnection, and to allow locking capabilities in addition to latching. Although the grooves 42 may not be specifically shown on conductor pins in all of the figures, it is understood that the conductor pins shown in the figures may optionally include grooves as described to engage the canted-coils springs located in the various connectors, or housings of the various connectors, as provided in accordance with exemplary embodiments of the present invention. The connector 10 allows the transfer of electrical current between the two cylindrical members 12, 14, via through the springs and the housing, while providing mechanical stability by allowing axial and radial movement and thermal expansion between the two members. Thus, the springs and the housing(s) are understood to be made from conductive materials. However, it is further understood that the tool-less connector may be used in non conducting applications, such as for use to connect two tubing or pipe sections together, for connecting two components together, etc.

Figure 1M:
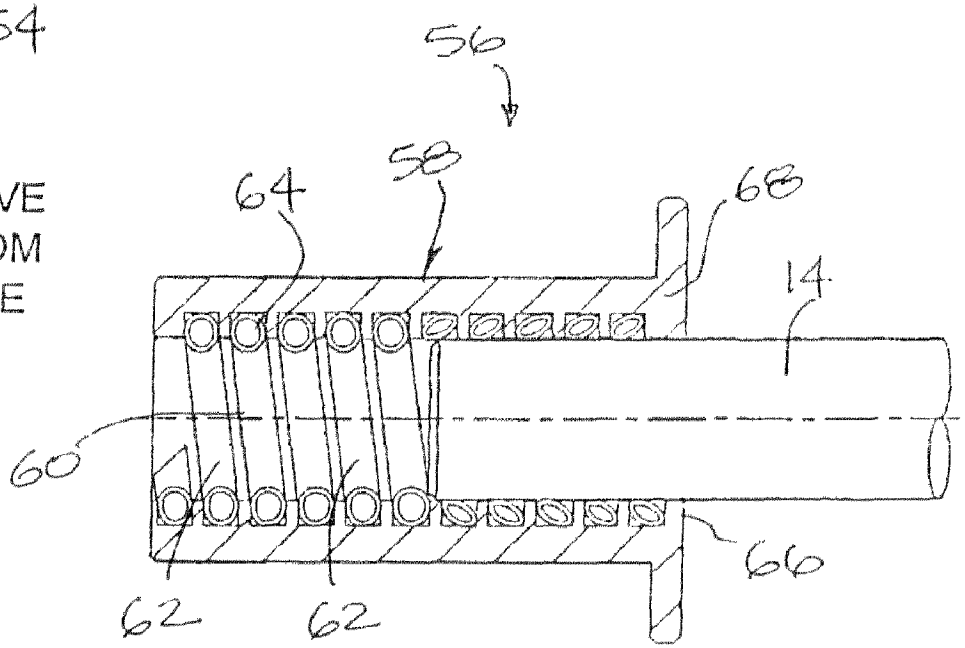
FIG. 1M is a cross-sectional side view of another exemplary connector of the present invention.
Figure 1D:
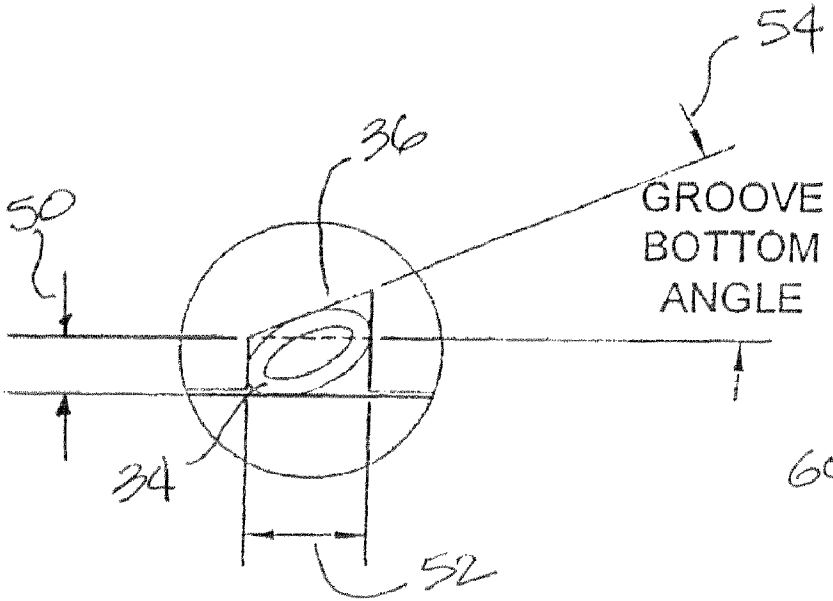
FIG. 1D is a detail cross-sectional side view of a conductor pin contacting a canted-coil spring in the connector of FIGS. 1A-1C.

FIG. 1D shows an enlarged view of canted-coil spring 34 housed in a spring groove 26 having a tapered bottom. Adjustments in groove height 50, groove width 52, and groove bottom angle 54 can vary the force of insertion and removal of cylindrical member 14 into and out of connector housing 16. Generally speaking, decreasing the groove height or groove width will increase the spring force of the canted-coil spring, and increasing the groove bottom angle increases the difference between insertion and removal force on the cylindrical members. The groove bottom angle may be formed on either side of the groove, i.e., inclined in either direction, to create a higher force in either direction. In other words, the groove bottom angle as shown in FIG. 1D may be a positive angle or a negative angle with respect to the surface of a cylindrical member inserted into the connector. Variations in groove height, groove width, and groove bottom angle in canted-coil spring grooves to provide different insertion or removal forces can be applied to any canted-coil spring groove of any of the connectors described herein. Additionally, one of ordinary skill in the art will appreciate that other groove configurations may be used within the scope and spirit of the present invention.

Thus, an aspect of the present connector embodiment is understood to include a connector housing comprising a plurality of springs located in a plurality of grooves, the housing comprising a central bore for receiving two elongated members, and wherein the elongated members are in sliding contact with the springs and in electrical communication with one another. The connector is further understood to provide a space or gap for the expansion of one or both elongated members due to thermal expansion by allowing one or both to axially slide relative to the housing while maintaining electrical communication with one another. More preferably, the two elongated members are in electrical communication with one another without directly contacting one another.

FIG. 1M shows another exemplary embodiment of a connector 56 provided in accordance with aspects of the present invention. The connector 56 comprises a housing 58 having a longitudinal bore 60. A continuous threaded groove 62, which resembles a spiral wound thread, extends around an interior circumferential surface of the longitudinal bore 60 along at least a portion of a length of the entire connector, into which a canted-coil spring 64 is wound and retained. The canted-coil spring 64 is prevented from winding out of the open ends of the groove 62 by stakes 66, 68 formed at the entrance of the bore. Alternatively, the ends of the groove 62 may be welded to the ends of canted-coil spring 64 to retain the spring therein. Still alternatively, an end flange or end plate may be bolted onto each end of the housing to retain the spring. Electrical current may be transferred between cylindrical members inserted into the connector 56, with only one member 14 shown. The connector 56, which comprises the housing 58 and the spring 64, provides means for electrical communication between two cylindrical members, rods, or pins and is configured for enhanced mechanical stability by allowing axial and radial movements and thermal expansion. For example, if the elongated member 14 expands due to heating, the connector easily accommodates the growth due to little or no solid abutment with the connector housing. Using a canted-coil spring wound into a threaded groove to provide circumferential force and to hold components or members in a connection assembly may be applied to any of the connectors described herein, as well as any other suitable connectors within the spirit and scope of the present invention.

Thus, aspects of the present invention is understood to include a connector comprising a housing having a first open end, a second open end, and an interior wall surface comprising two or more grooves, wherein a spring section is positioned in each of the two or more grooves, and wherein an elongated member projects through the first open end or the second open end and is adaptable to extend through the other one of the first open end or the second open end. In a further aspect of the present invention, the two or more grooves are part of a continuously formed groove such that the two or more grooves are in communication with each other. In a still further aspect of the present invention, the spring section comprises a continuous spring coil. In a most preferred embodiment, a second elongated member fiber extends through the other one of the first open end or the second open end and wherein the elongated member and the second elongated member do not directly contact one another.

FIGS. 2A-2D show another exemplary connector 70 for connecting unthreaded cylindrical members 12, 14 (FIG. 2C), similar to the connector shown in FIG. 1A. The connector may be used for mechanical, electrical, EMI, and/or grounding applications and in a most preferred embodiment is configured for frictional retention of the elongated members. In particular embodiments, the frictional retention force is generated from one or more springs. Thus, an aspect of the present connector is a connector housing configured to receive at least two elongated members and wherein the elongated members are axially movable relative to the housing and wherein the housing provides the means for electrical flow between the two elongated members. Advantageously, the connector permits axial and radial movements to accept wide variations in temperature as well as wide tolerances between the members, as further discussed below.

Figure 2A:
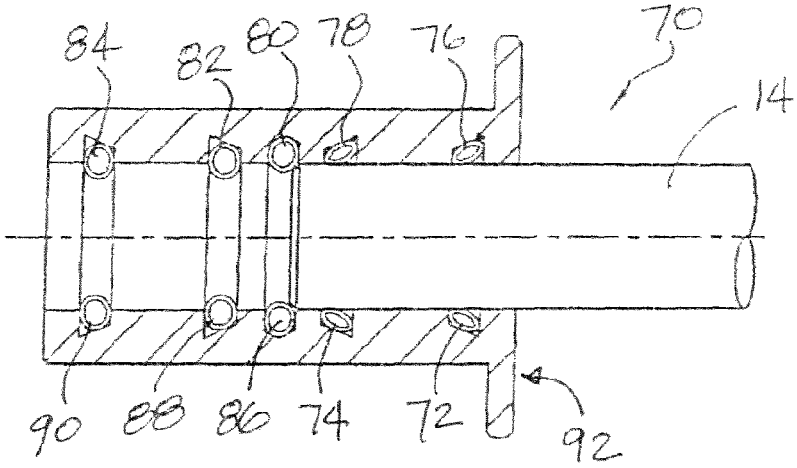
FIGS. 2A, 2B, 2C, and 2D are cross-sectional side views of yet another exemplary connector of the present invention during various states of engagement with conductor pins.

FIG. 2A shows the connector 70 partially mounted on a cylindrical member 14 held in place by a plurality of canted-coil springs, such as two springs 72, 74 housed in spring grooves 76, 78. In the embodiment shown, the connector 70 further comprises three additional grooves 80, 82, 84 for a total of five grooves, each groove housing a canted-coil spring 86, 88, 90, respectively. The grooves 80, 82, 84, 76, 78 may embody any one type or any combination of tapered, v-bottom, or flat bottom grooves to provide different forces in different directions. Furthermore, canted-coil springs 86, 88, 90, 72, 74 may be any one type or any combination of radial, axial, and angular canted-coil springs to provide different forces, tolerances, and characteristics of conductivity.

Figure 2B:
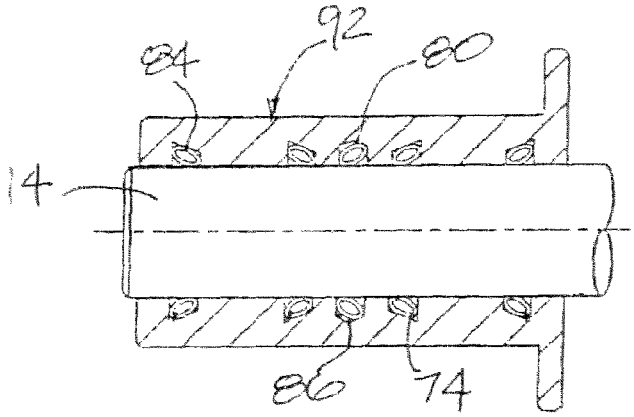
Figure 2C:
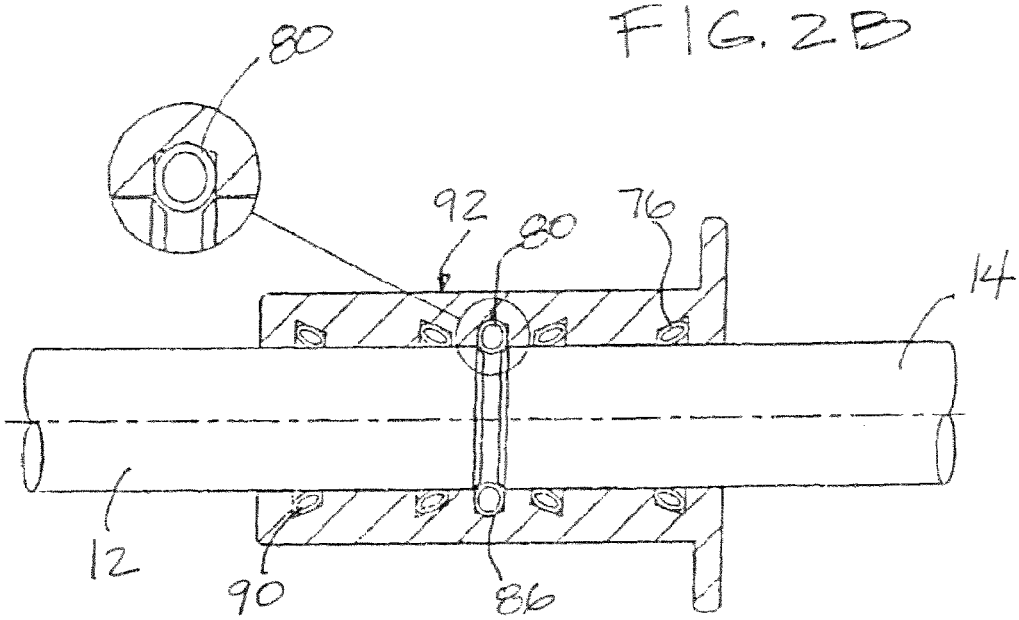

FIG. 2B shows connector 70 mounted onto the cylindrical member 14, the size of which causes the canted-coil springs 86, 88, 90, 72, 74 to compress. FIG. 2C shows the assembled connector 70 mounted onto two cylindrical members 12, 14 wherein the first cylindrical member 12 is held by canted-coil springs 86, 88 and the second cylindrical member 14 is held by canted-coil springs 72, 74. The interior canted-coil spring 86 housed in the interior groove 80 provides a physical separation between the two cylindrical members 12, 14, yet since both cylindrical members contact the spring, electrical continuity can be maintained. Thus, aspect of the present invention is understood to include a connector housing comprising bore comprising a plurality of grooves having a plurality of springs located therein, which includes an interior groove and an interior spring; wherein two elongated members are located in the bore and held therein by the plurality of springs; and wherein the interior spring is in contact with both elongated members to provide a gap therebetween.

Similar to previously described embodiments, the cylindrical members 12, 14 may comprise grooves formed around an exterior circumferential surface of the members similar to the grooves 42 shown in FIG. 1G to engage canted-coil springs 86, 88, 72, 74. The grooves may embody any one type or any combination of tapered, v-bottom, or flat bottom grooves to provide different forces in connecting and disconnecting and allow locking capabilities in addition to latching. The connector 70 may transfer electrical current between the two cylindrical members 12, 14 while providing mechanical stability by allowing axial and radial movement and thermal expansion. Thus, in high temperature applications, the connector is adapted to permit radial and axial expansions of the two elongated members by permitting relative axial and radial movements with the housing.

Note that the housing 92 is first slid completely over the first cylindrical member 14 (FIG. 2B) so that the second member 12 can then be aligned (FIG. 2C), at which point the housing 92 is slid back over the second member 12. Alternatively, the two cylindrical members may be inserted through the respective open ends of the housing 92. Thus, aspects of the present invention a method for mounting a connector comprising a housing and having a bore onto two elongated members having ends that are positioned end to end, and wherein the housing is slid substantially onto one of the two members before the housing is slid onto the second elongated member.

Figure 2D:
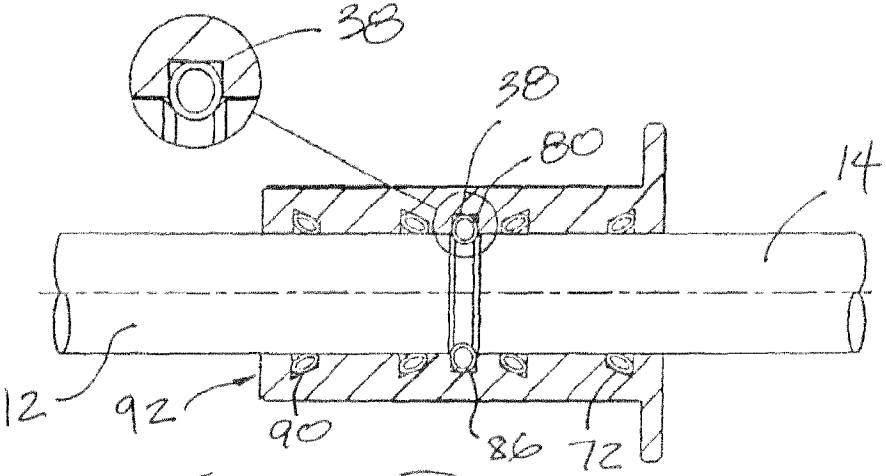

FIG. 2D shows another exemplary embodiment of a connector having a flat bottom groove 38 providing a decreased depth of canted-coil spring 86 in groove 38 and/or providing a higher spring force, particularly such that the spring force does not allow either cylindrical member 12 or 14 to penetrate past the spring 86, which acts as a stop in the center of the connector 70, unless a severe axial force is applied to the cylindrical member, such as to permanently deform the spring 86. In one exemplary embodiment, assembly of the members involves inserting cylindrical members 12, 14 into the connector 70 from opposite ends of a longitudinal bore such that the cylindrical members do not have to be inserted over the spring 38. Note that in other embodiments, the interior spring 86 may be penetrated or passed by providing a different groove configuration.

FIGS. 3 through 9 show other exemplary connector embodiments for connecting separated cylindrical members in accordance with aspects of the invention. These connectors incorporate various features, but preferably are designed to carry electrical current from one elongated member or conductor pin to another, while providing assembly, disassembly, and holding, latching, and/or locking capabilities to allow easy installation and repair in tight or difficult to reach spaces and under high temperature conditions. Many of today's current carrying applications may be under severe weather and temperature conditions in remote areas where reliability and assembly by means of a connection using tools may not be possible or practical. The connectors provided herein are configured to simplify and serve those applications in an efficient and useful manner.

Similar to the connectors described above, grooves incorporated in the connectors illustrated in FIGS. 3-9 may embody any one of or any combination of tapered, v-bottom, or flat bottom grooves to provide different forces in different directions. Canted-coil springs in the following connectors may be any one type or any combination of radial, axial, and angular canted-coil springs to provide different forces, tolerances, and characteristics of conductivity. A continuous circular groove may also be incorporated into the inner circumferential surface of the housing similar to the groove shown in FIG. 1M.

Referring specifically now to FIGS. 3A-3D, there are shown in the several figures a collapsible axial in-line electrical connector 94 that may be used with but preferably without a tool. The figures represent the assembly in different states or stages of assembly or disassembly. Canted-coil springs 96, 98 located within the circumferential housing 100 serve to retain, lock, and permit axial and radial movement of in-line conductor pins 102, 104 to allow variation in temperature and tolerances between conductor housings. As shown in the figures, the in-line electrical connector 94 includes a retaining cylinder 106 slidingly mounted within the circumferential housing 100 in a telescoping configuration. As further discussed below, this allows the connector to be collapsed to install, assemble, or disassemble the conductor pins.

Figure 3A:
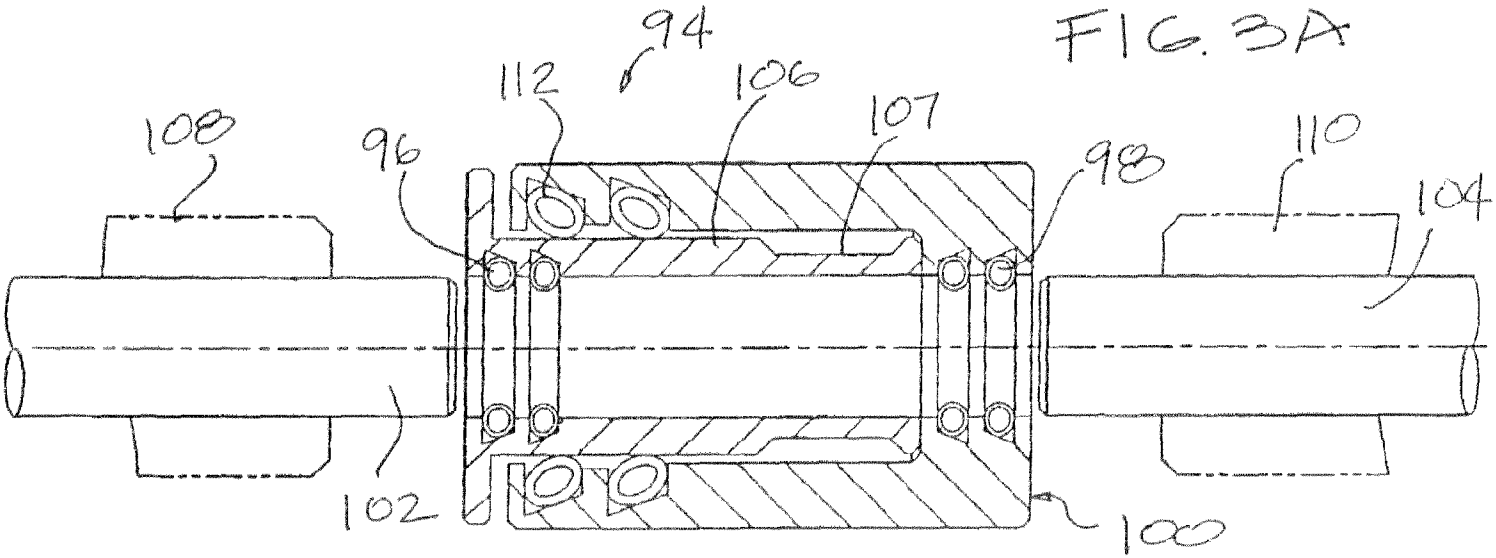
FIGS. 3A, 3B, 3C, and 3D are cross-sectional side views of still another exemplary connector of the present invention during various states of engagement with conductor pins.
Figure 3B:
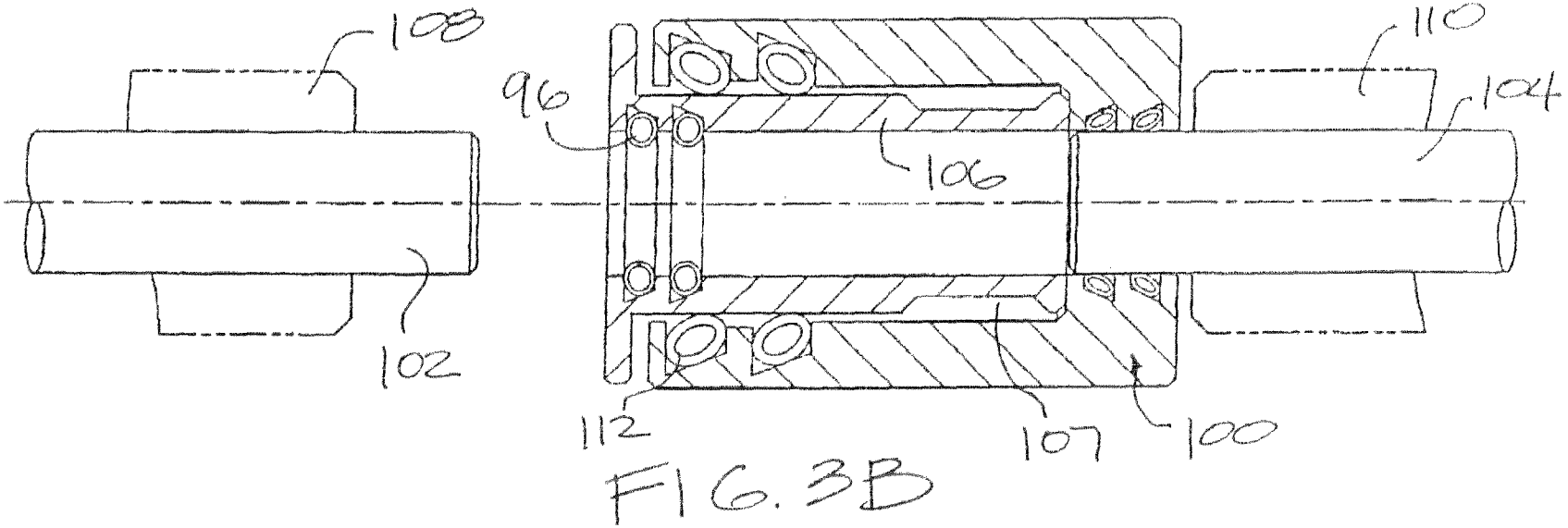

FIG. 3A shows the connector 94 in a collapsed configuration with the retaining cylinder 106 slid into the outer housing 100 and positioned for in-line assembly onto the conductor pin 102, which is attached to a pin housing 108, shown schematically only and may represent any number of shapes, sizes, and/or configurations. The connector is also ready for in-line assembly onto the second conductor pin 104, which is similarly attached to a pin housing 110. The connector 94 comprises the internal retaining cylinder 106 adapted to receive the conductor pin 102 and includes a plurality of springs, such as two canted-coil springs 96, mounted on an interior surface of the retaining cylinder 106 to retain the conductor pin therein. The retaining cylinder 106 is located within an outer sleeve circumferential housing 100 in which a plurality of canted-coil springs 112, such as two springs 112, are mounted and is retained by the canted-coil springs. The retaining cylinder 106 includes a retaining groove 107 adapted to receive canted-coil springs 112 to restrict the retaining cylinder 106 from disengaging from the housing 100 once engaged. FIG. 3B shows the connector 94 wherein conductor pin 104 has been assembled onto the housing 100, thereby radially compressing canted-coil springs 98 and being retained on the housing.

Figure 3C:
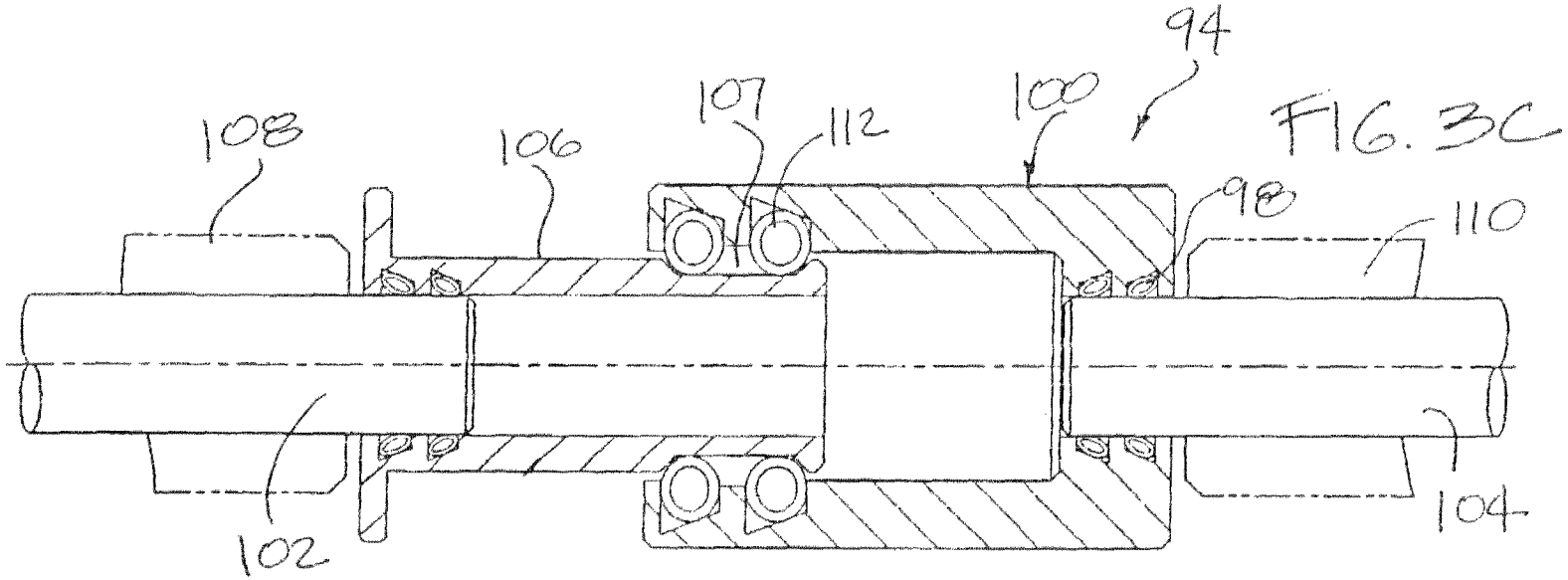

FIG. 3C shows the connector 94 assembled onto the two pins 102, 104 with the internal retaining cylinder 106 fully extended and the canted-coil springs 112 engaging the retaining groove 107 on the cylinder to restrict axial movement of the retaining cylinder 106 and place the connector 94 in a firm loaded position. In this position, current can flow from the conductor pin 102 through canted-coil springs 96 and internal retaining cylinder 106, through canted springs 112, through circumferential housing 100 and canted-coil springs 98 and into conductor pin 104. In one exemplary embodiment, to disassemble the connector, the internal retaining cylinder 106 is collapsed back into circumferential housing 100, overcoming the spring force of canted springs 112. In such a position, the axial friction force of canted springs 96 may be overcome and the conductor pin 10 may be removed.

Figure 3D:
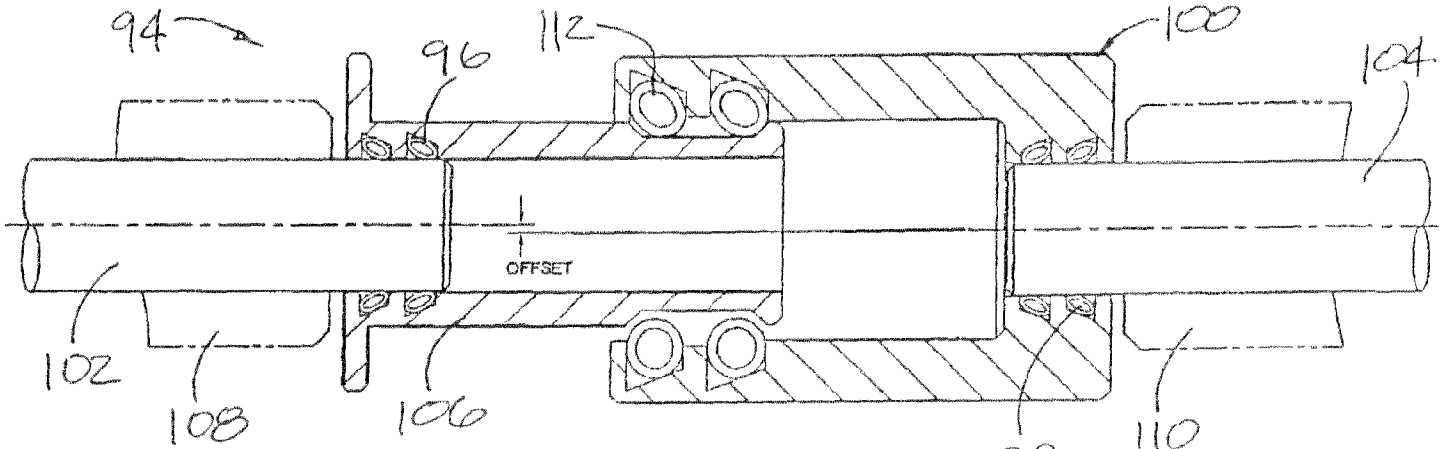

FIG. 3D shows a degree of radial offset between the conductor pins 102, 104 caused by the radial deflection of springs 96, 112, and 98. The offset may be due to misalignment, warping, damage, and/or deflection of one or both of the conductor pins. In one exemplary embodiment, the amount of offset may be about 0.030 inches. However, one of ordinary skill in the art will appreciate that configurations allowing for more or less offset may be designed without departing from the spirit and scope of the invention.

Thus, aspects of the present invention is a connector comprising a bore having a first spring positioned in a groove, a retaining cylinder comprising a bore having a second spring positioned in a groove and an exterior surface; wherein the exterior surface of the retaining cylinder is in sliding communication with the first spring and wherein the bore of the retaining cylinder is configured to receive a conductive elongated member.

Figure 4A:
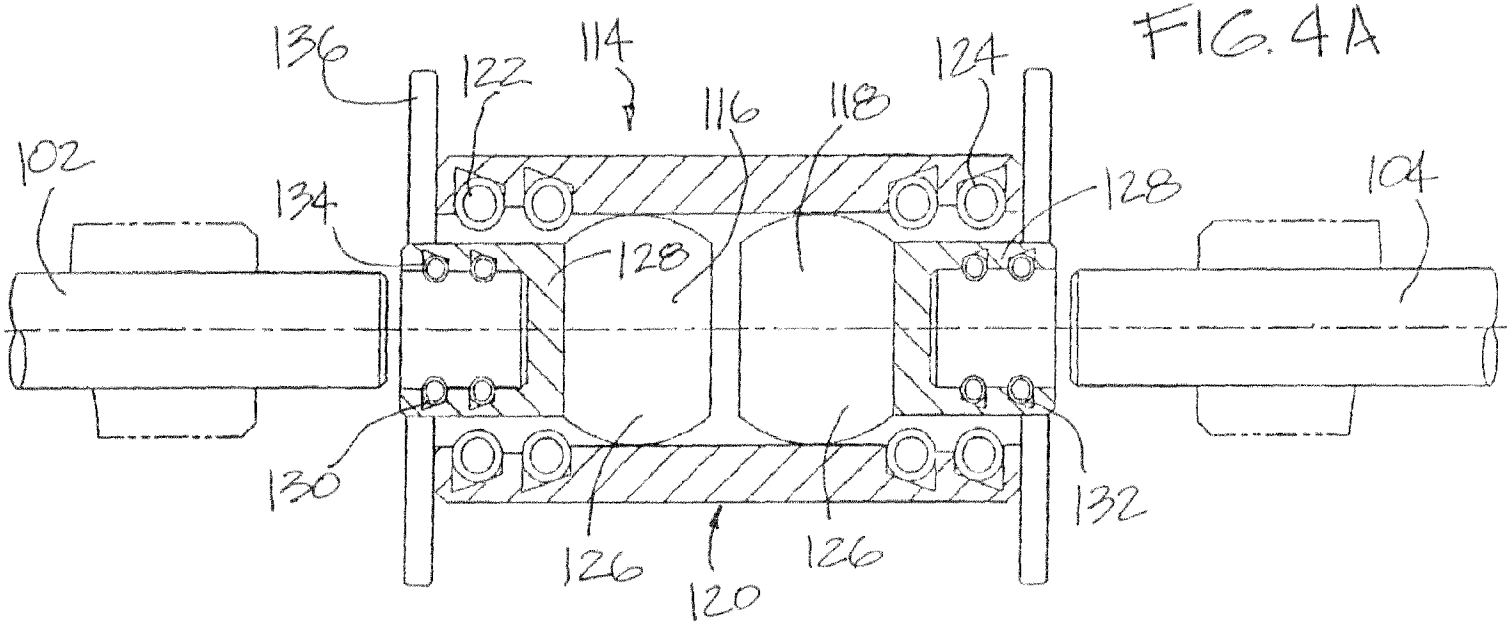
FIGS. 4A, 4B, 4C, and 4D are cross-sectional side views of yet another exemplary connector of the present invention during various states of engagement with conductor pins.
Figure 4B:
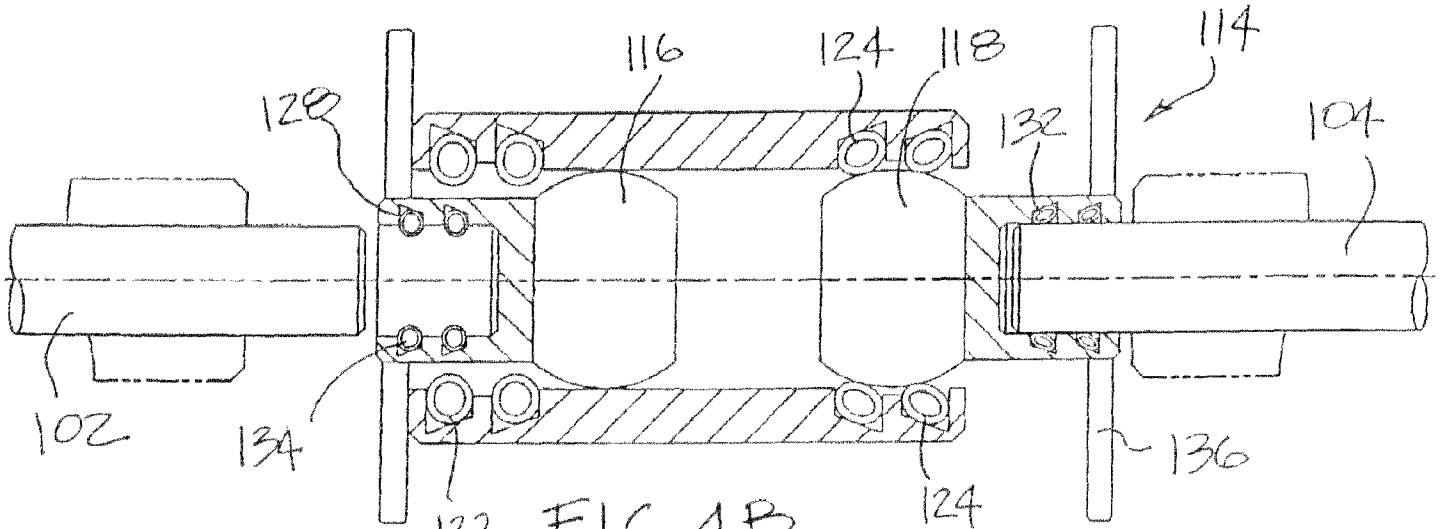

FIGS. 4A-4D show another exemplary embodiment of an in-line collapsible connector with provisions for accommodating axial, radial and/or angular misalignment and usable without a tool. With reference to FIG. 4A the connector 114 may include housing pins or retaining cylinders 116, 118 slidingly connected within a longitudinal bore of a circumferential housing 120, and axially retained therein by two outer axial canted-coil springs 122, 124. The housing pins 116, 118 each includes a partially spherical base 126 adapted to move in and out of a set of retaining springs 124 for placing the housing pin in either an extended position or a collapsed position. Each pin further includes a receiving portion 128, similar to a collar, adapted to receive a conductor pin 102 or 104. Thus, the housing pins function like the retaining collar or cylinder of FIGS. 3A-3D. The receiving portion 128 includes canted-coil springs 130, 132 housed in spring grooves 134 for gripping the pins. Alternatively, the pins 102, 104 may incorporate grooves and the springs 130, 132 interact with the grooves on the conductor pins, (See, e.g., FIG. 1G). Additionally, a flange 136 extending from an end of the housing pins 116, 118 limits the distance which the housing pins can slide into the housing 120. FIG. 4B shows a first housing pin 118 of the connector 114 assembled onto a first conductor pin 104, the first housing pin being retained within the circumferential housing 120 by the deflection of canted-coil springs 124.

Figure 4C:
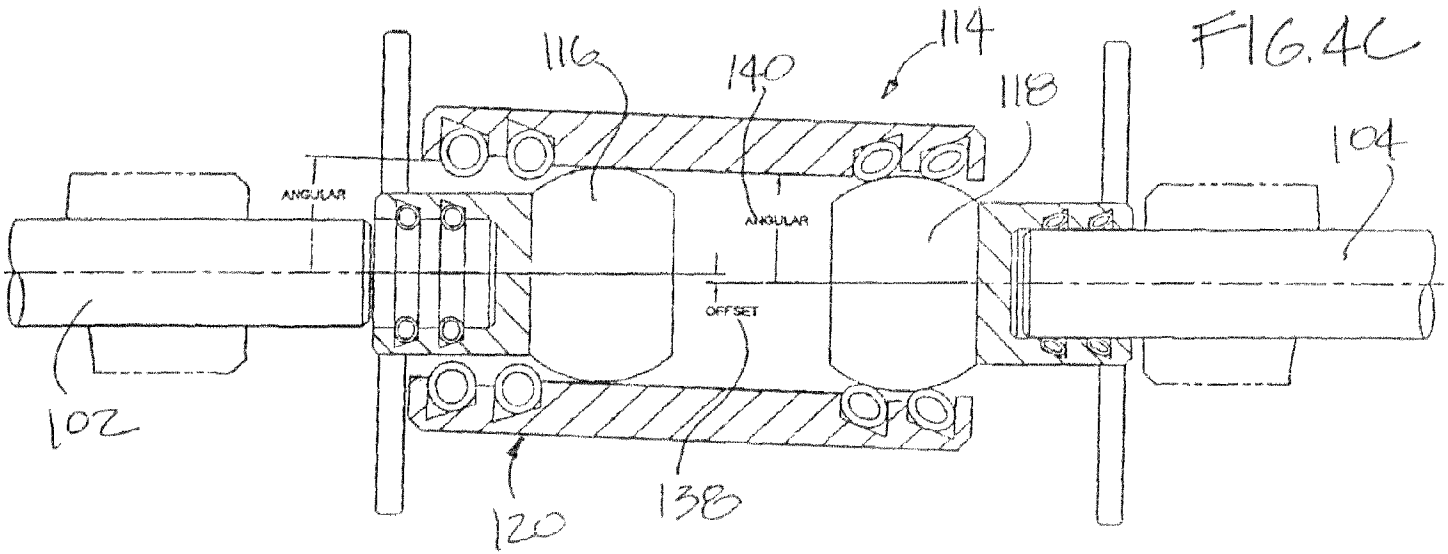

FIG. 4C shows the offset 138 and angular displacement 140 that can be achieved while assembling the spherical housing pin 116 onto conductor pin 102 when the housing pins are in the collapsed position. In one exemplary embodiment, the amount of offset may be about 0.040 inches. However, one of ordinary skill in the art will appreciate that configurations allowing for more or less offset may be designed without departing from the spirit and scope of the invention.

Figure 4D:
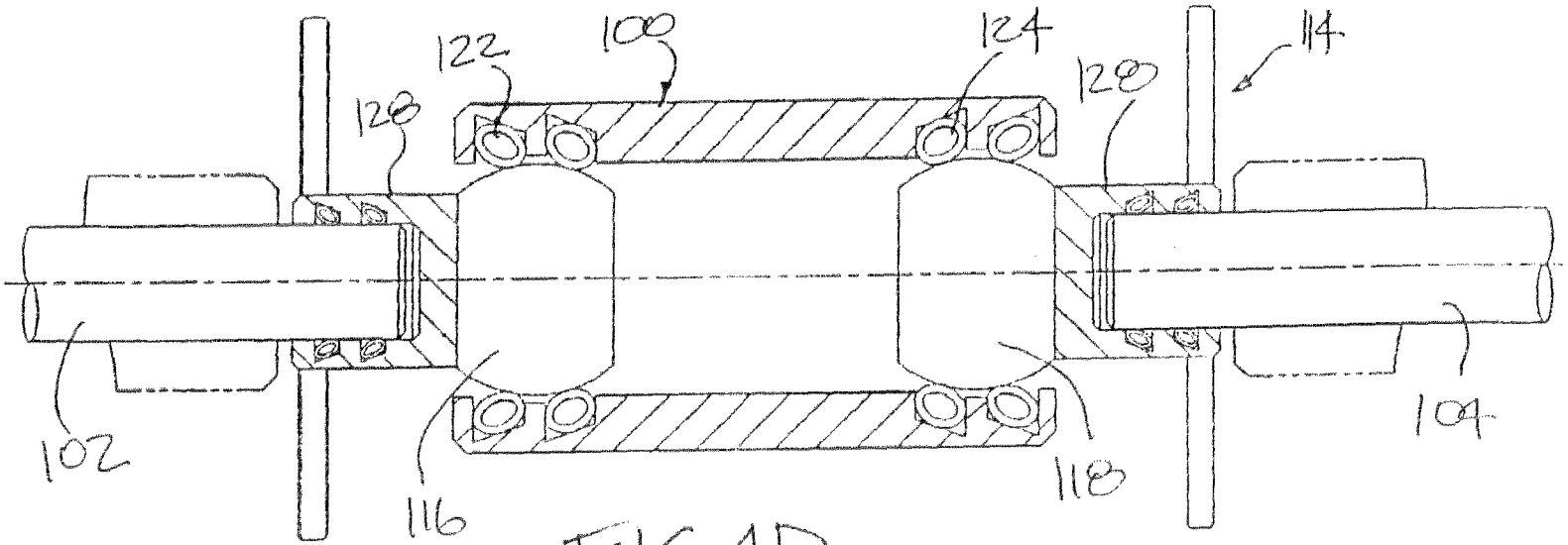

FIG. 4D shows the electrical connector 114 fully assembled with two spherical housing pins 116, 118 locked within the longitudinal bore by retaining canted-coil springs 122, 124, respectively. The connector 114 is fully extended and held in a locked position, restricting the axial movement of the pins 116, 118. The connector may be disassembled by moving the spherical housing pins 116, 118 toward each other (as shown in FIG. 4A) and overcoming the radial springs force of axial springs 132, 124 and springs 130, 122. Current flows from the conductor pin 102 through springs 130 to pin 116, from pin 116 through springs 122 to housing 120, from housing 120 through springs 124 to pin 118, and finally from pin 118 through springs 122 to pin 104 and on to the electrical grid.

Thus aspect of the present invention is understood to include a connector having two axially movable housing pins each comprising a partial sphere for retaining contact between at least two springs located in the bore of the connector housing. The partial sphere allows the housing pins to rotate, pitch, or yaw relative to the housing. In one embodiment, the each housing pin further includes a collar comprising a groove and a spring located therein for receiving and providing a spring force on an elongated member.

Figure 5A:
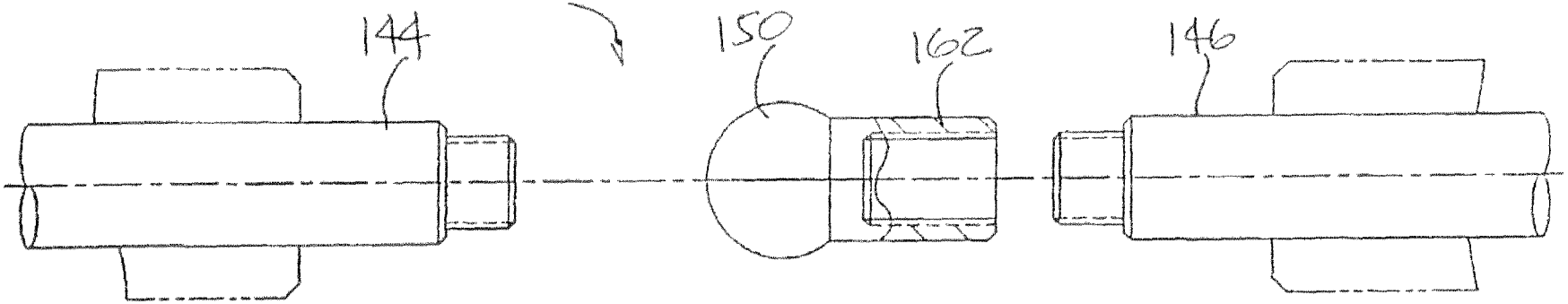
FIGS. 5A, 5B, and 5C are cross-sectional side views of still another exemplary connector of the present invention during various states of engagement with conductor pins.
Figure 5B:
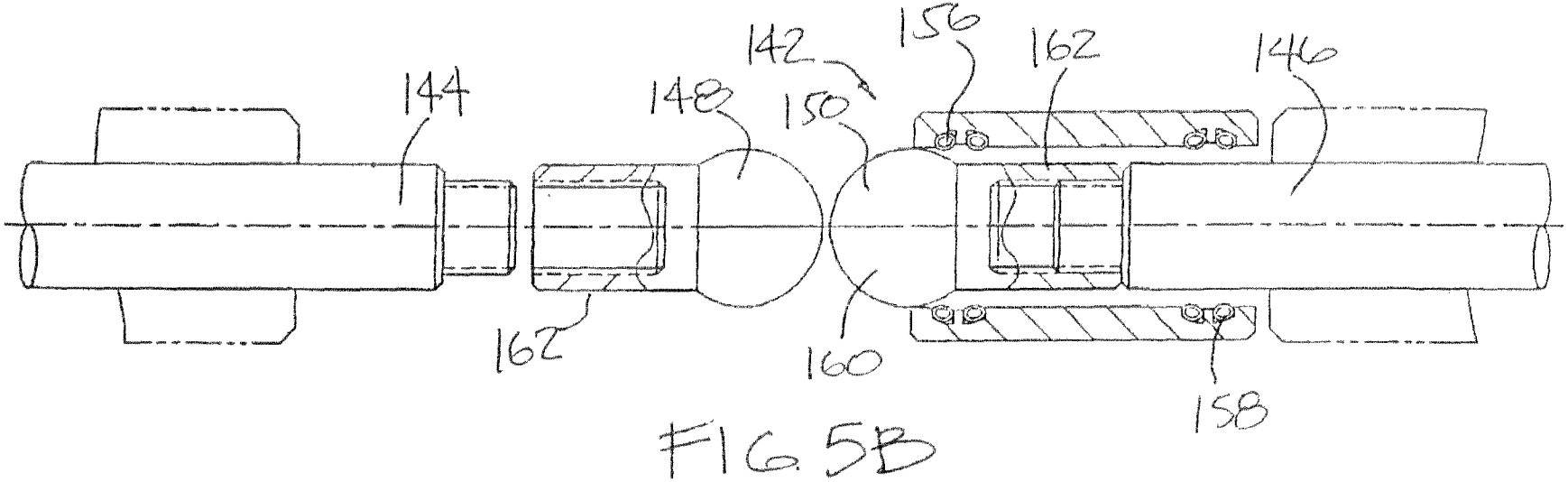

FIGS. 5A-5D show another exemplary embodiment of a non-collapsible in-line electrical connector 142 with provisions for accommodating axial, radial and/or angular misalignments, similar to the connector shown in FIGS. 4A-4D, but having threaded conductor pins 144, 146 and threaded connector pins or housing pins 148, 150. As shown in FIGS. 5A and 5B, the connector 142 comprises a circumferential housing 152 with a longitudinal bore and a pair of grooves 154 housing canted-coil springs 156, 158, which engage housing pins 148, 150 and retain the housing pins within the housing. The housing pins 148, 150, which have a partial spherical base 160 and a threaded receiving section 162, are threaded to the conductor pins 144, 146 to electrically connect the conductor pins to the connector 142.

Figure 5C:
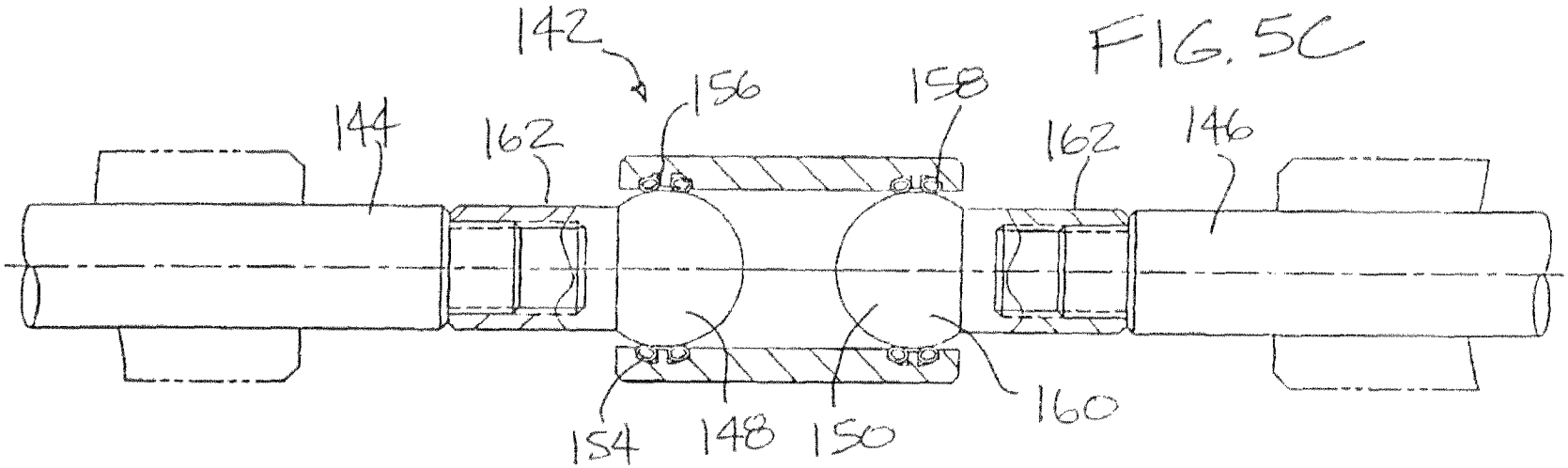
Figure 5D:
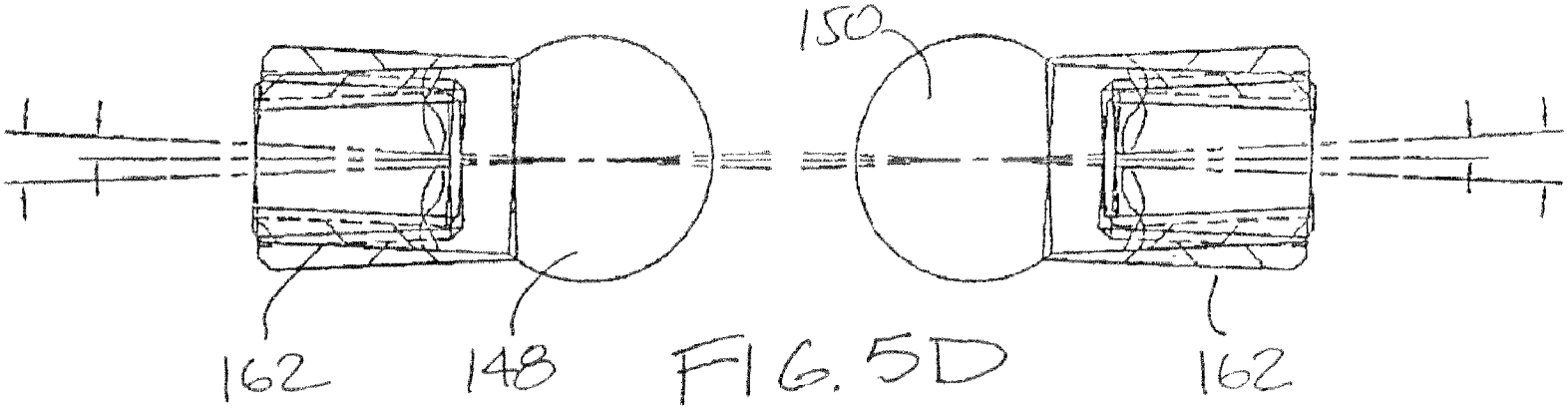
FIG 5D is a cross-sectional side view of connector pins of the connector of FIGS. 5A-5C illustrating an amount of possible offset of axes of the connector pins.

FIG. 5C shows each threaded ball connector 148, 150 threaded to a respective connector pin 144, 146. FIG. 5D shows the angular maximum/minimum position of one exemplary embodiment that the ball connectors 148, 150 can accommodate relative to the connector pins, in addition to the permissible offset the ball connectors can have relative to the connector housing. Similar to the previously described embodiments, current flows from conductor pin 144 to conductor pin 146 through the piston mounted different components 148, 156, 152, and 150.

Thus aspect of the present invention is understood to include a connector having two axially movable housing pins each comprising a partial sphere for retaining contact between at least two springs located in the bore of the connector housing. The partial sphere allows the housing pins to rotate, pitch, or yaw relative to the housing. In one embodiment, the each housing pin further includes a collar comprising internal threads for receiving and threading with a conductor member, such as a conductive pin.

Figure 6A:
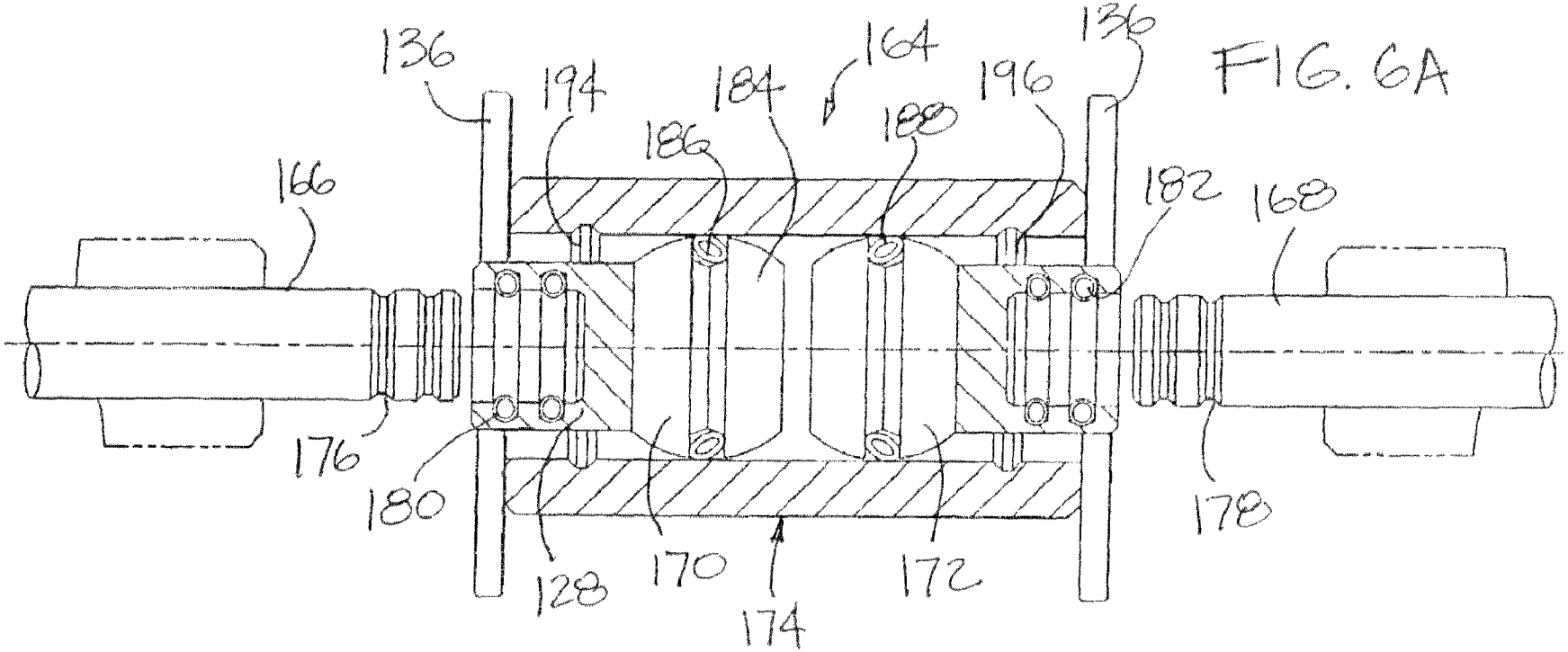
FIGS. 6A, 6B, and 6C are cross-sectional side views of yet another exemplary connector of the present invention during various states of engagement with conductor pins.
Figure 6B:
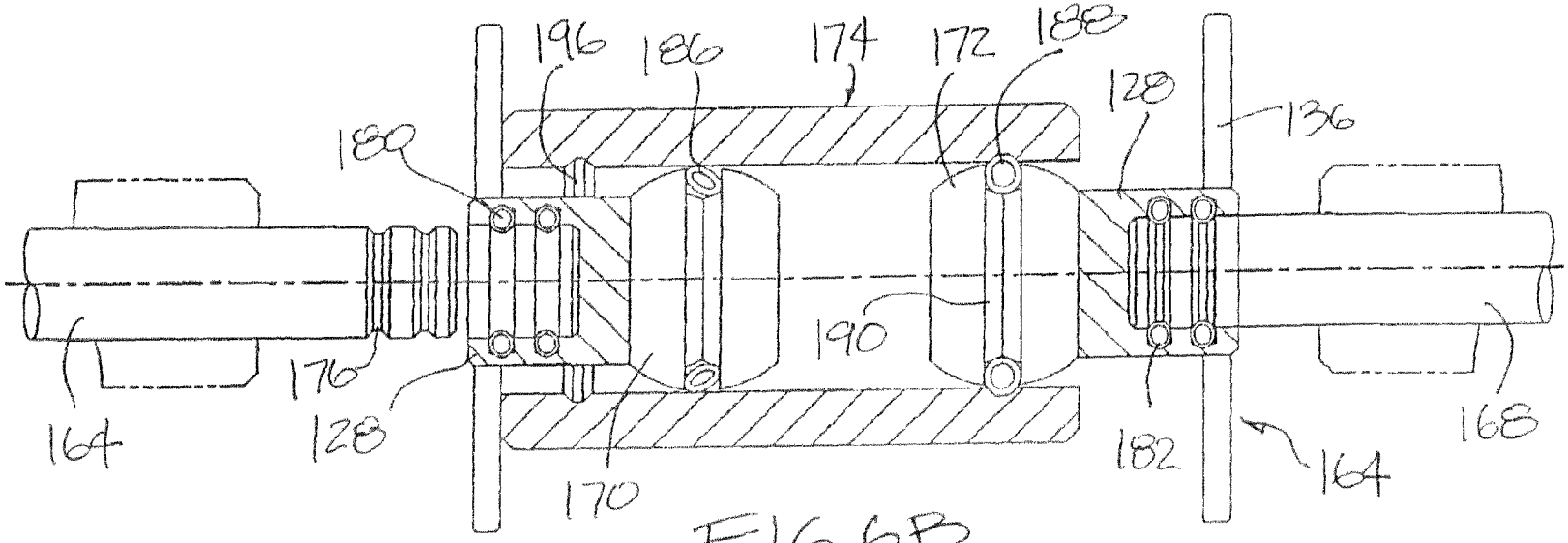
Figure 6C:
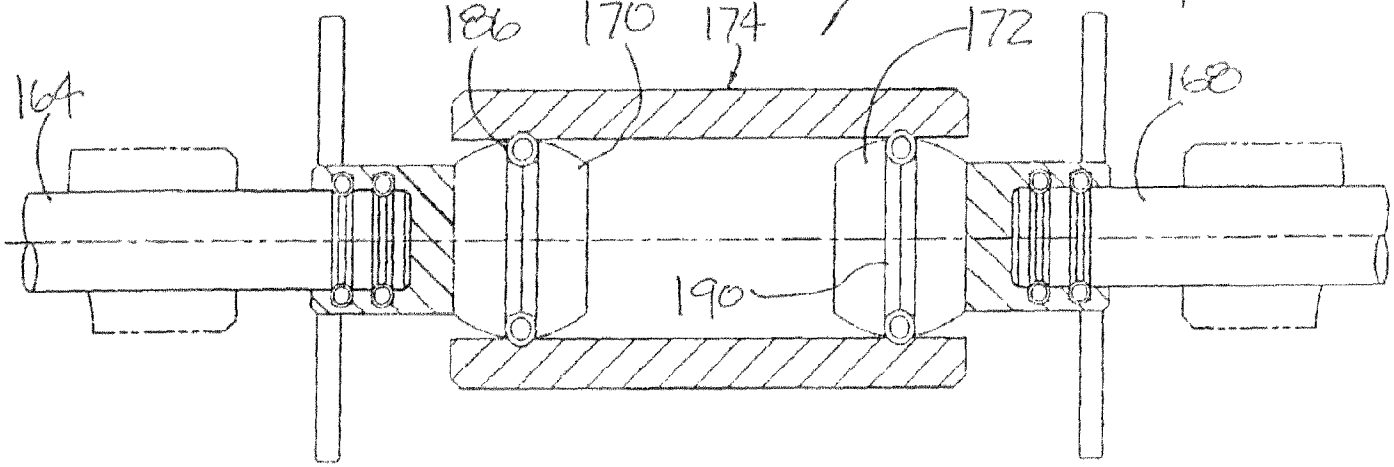

FIGS. 6A, 6B, and 6C show another exemplary embodiment of an in-line collapsible electrical connector 164 with provisions for accommodating axial, radial and or angular misalignment between the two conductor pins. The conductor pins, each having an axial end surface, are typically positioned in abutting relationship to one another but generally do not contact and often are offset from one another, either axially, radially or both. Occasionally, thermal expansion can cause the two members to be offset.

FIG. 6A shows the connector 164 in a collapsed position ready for assembly onto a first and a second conductor pins 166, 168. The connector 164 includes two ball connectors 170, 172 adapted to receive two conductor pins 166, 168 and permit electrical communication between the two through the circumferential housing 174. More specifically, ends of conductor pins 166, 168 include grooves 176, 178 which engage retaining springs 180, 182 to retain the conductor pins within the ball connectors 170, 172. Additionally, the ball connectors 170, 172 are slidable with respect or relative to the housing 174 between a recessed position (FIG. 6A) in which a tab 136 abuts an end of the housing 174 and an extended position (FIGS. 6B and 6C) in which a receiving portion 128 of the ball connectors 172, 170 extends from the housing. To prevent a base 184 of the ball connectors 172, 170 from disengaging from the housing, canted-coil springs 186, 188 are housed in spring grooves 190, 192 in the base. When the canted-coil springs 186, 188 encounter grooves 194, 196 in the housing, the resistance created between the canted-coil springs and the grooves prevent the ball connectors 170, 172 from disengaging from the housing 164. As shown in FIG. 6C, when the connector 164 is in the extended position, electrical current can flow from the first conductor pin 166 to second conductor pin 168 through the conductor 164 and into the power grid.

Figure 7A:
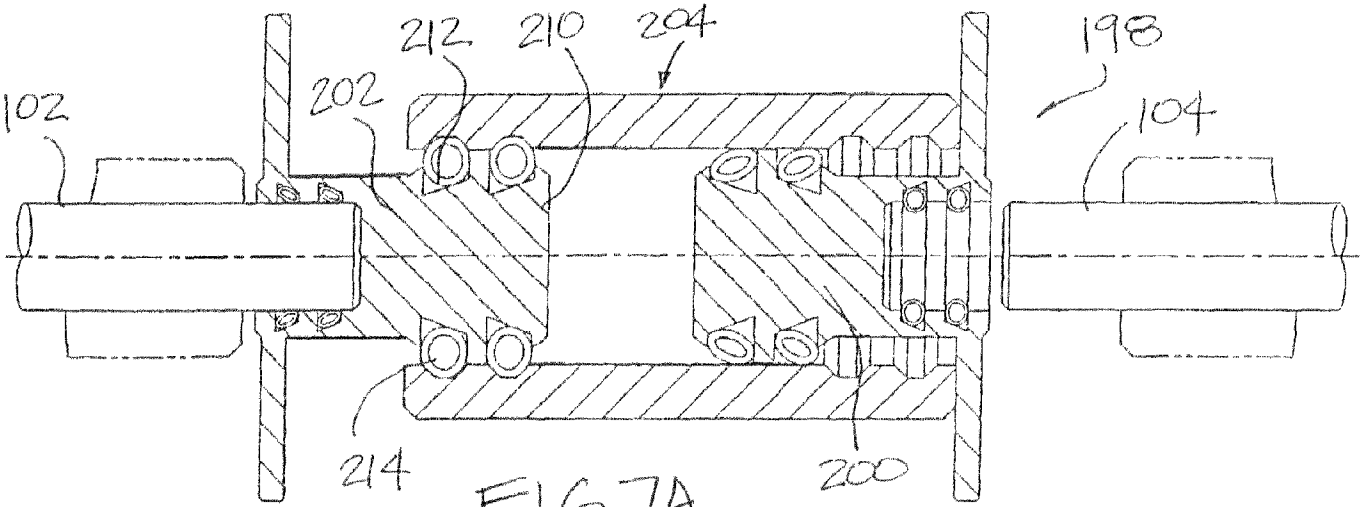
FIGS. 7A, 7B, 7C, and 7D are cross-sectional side views of still another exemplary connector of the present invention during various states of engagement with conductor pins.
Figure 7B:
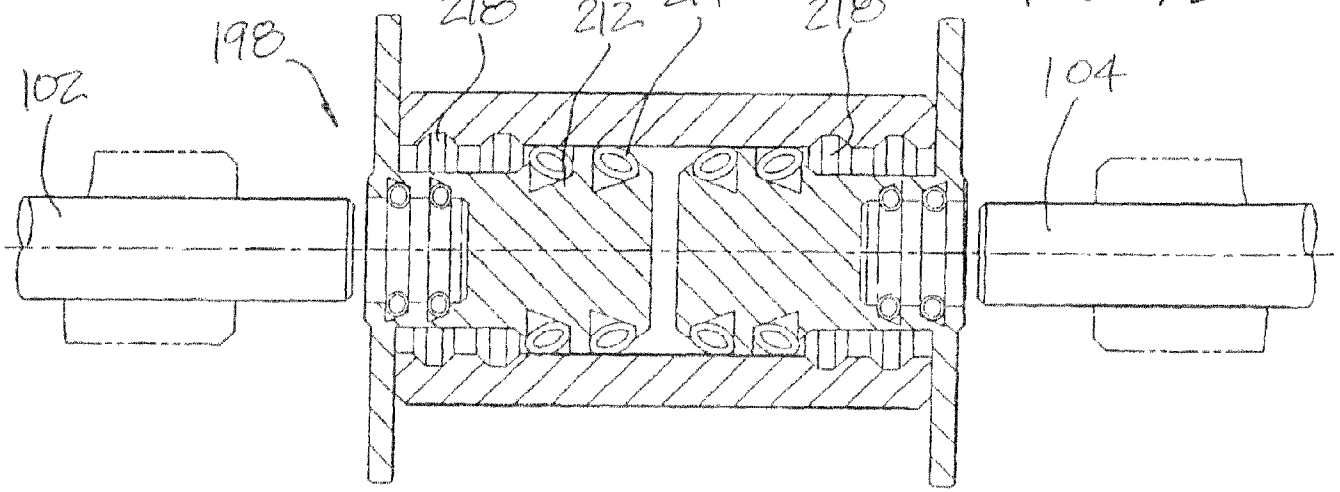
Figure 7C:
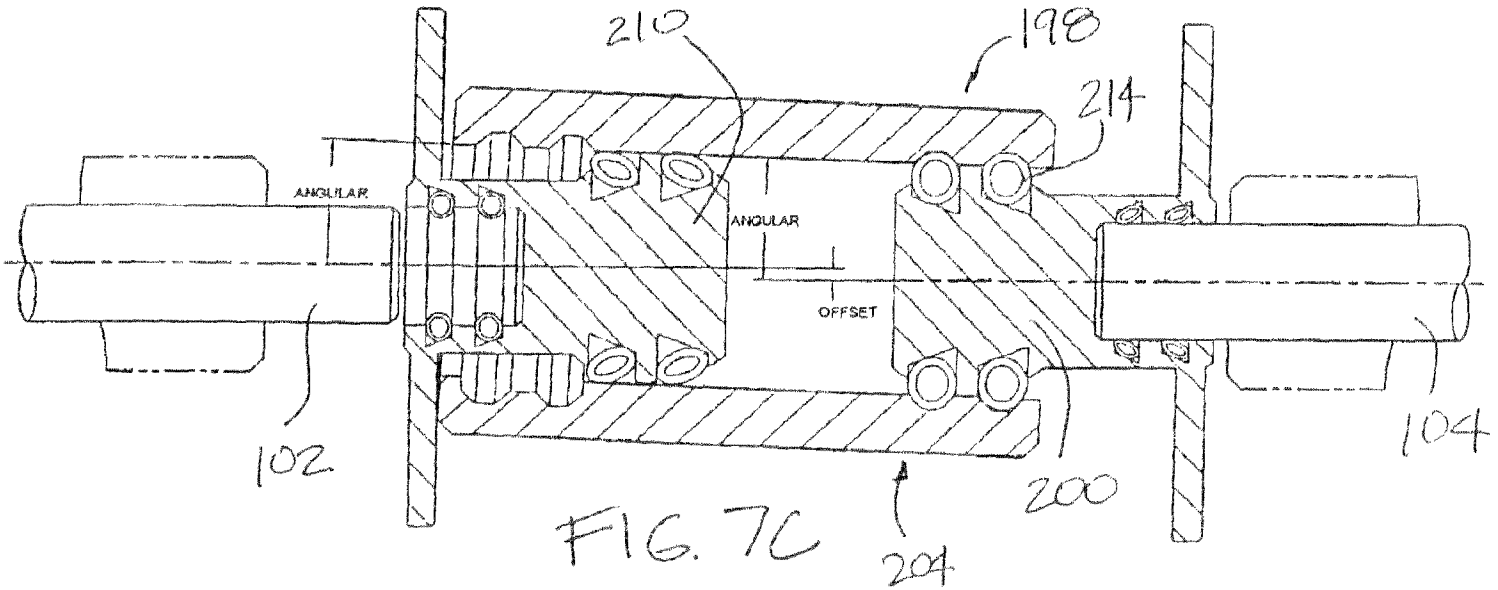
Figure 7D:
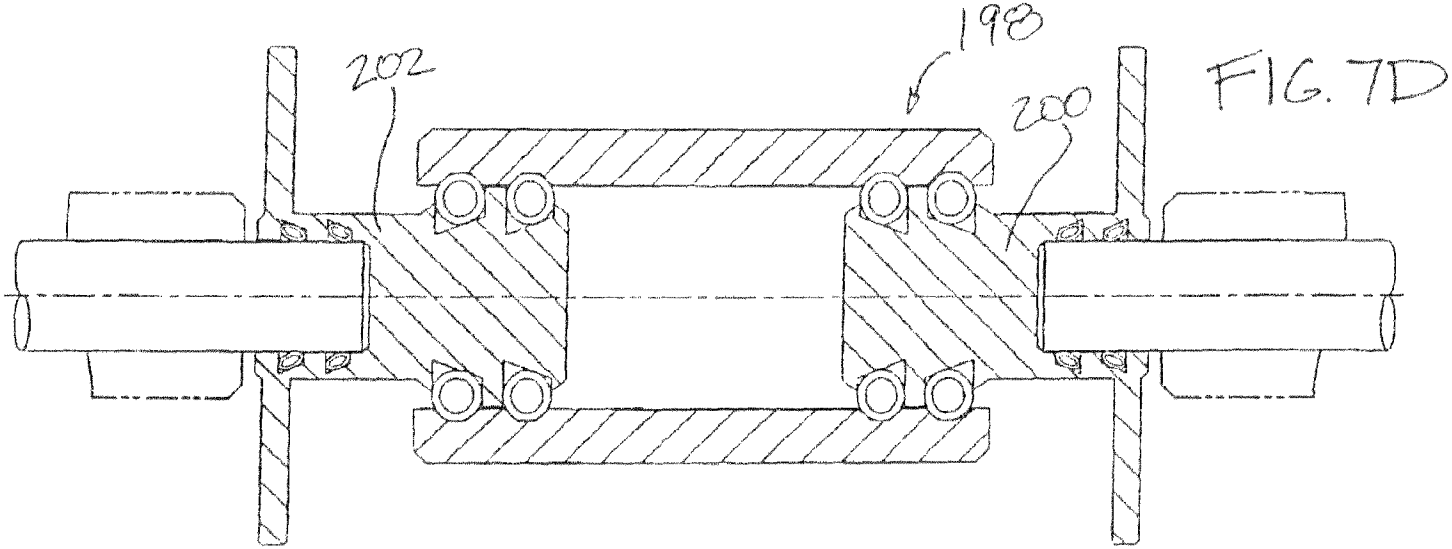
Figure 8A:
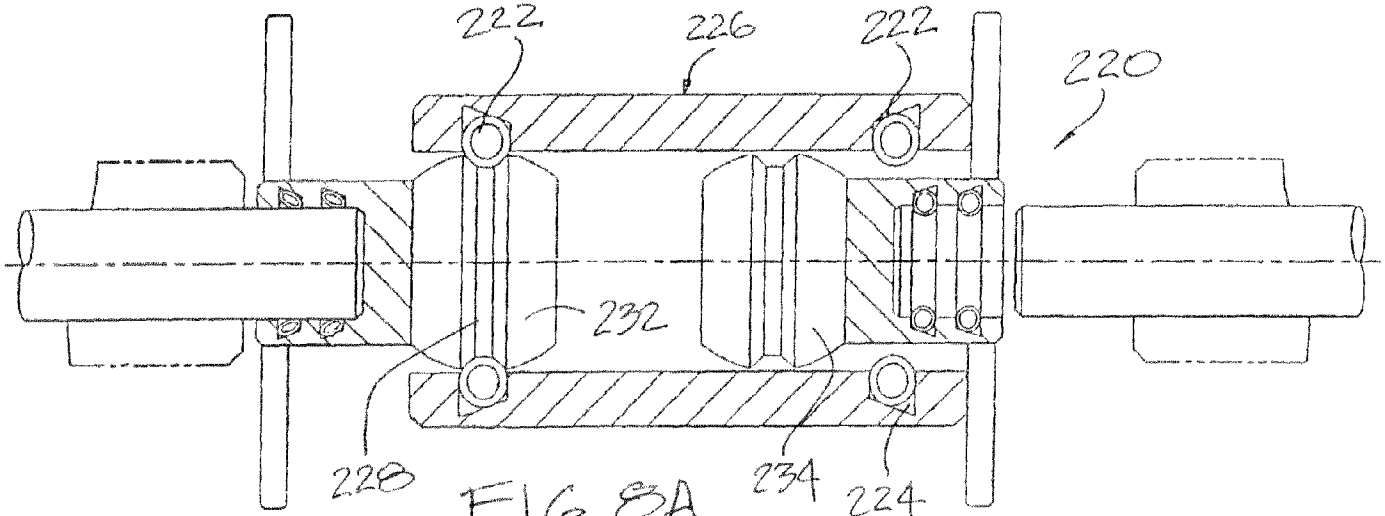
FIGS. 8A, 8B, 8C, and 8D are cross-sectional side views of yet another exemplary connector of the present invention during various states of engagement with conductor pins.
Figure 8B:
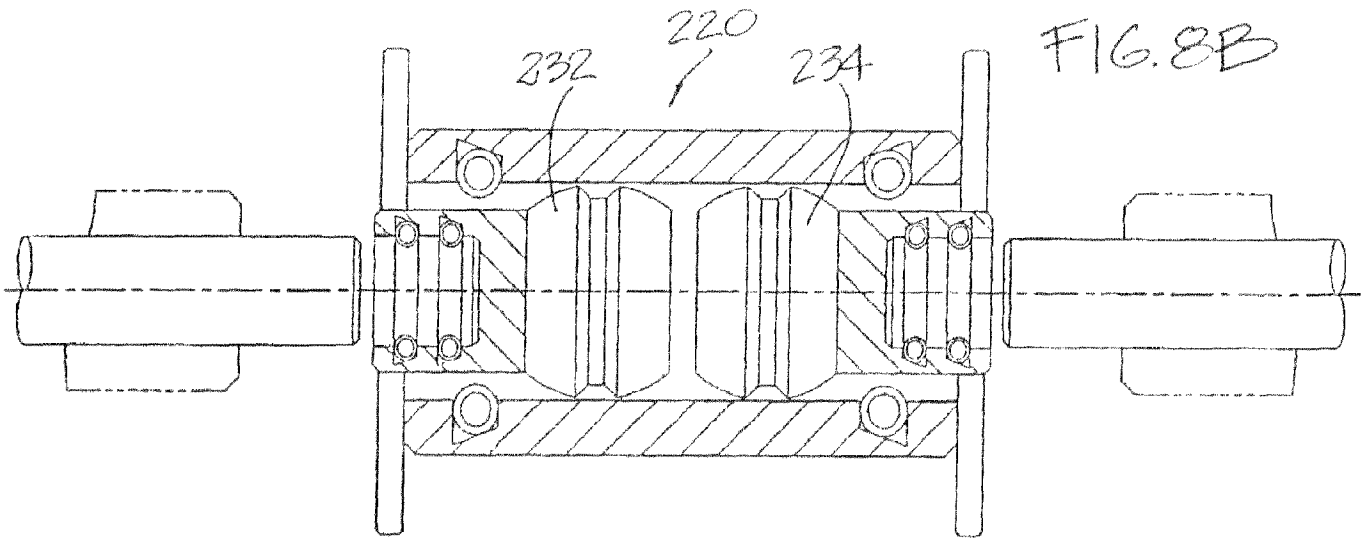
Figure 8C:
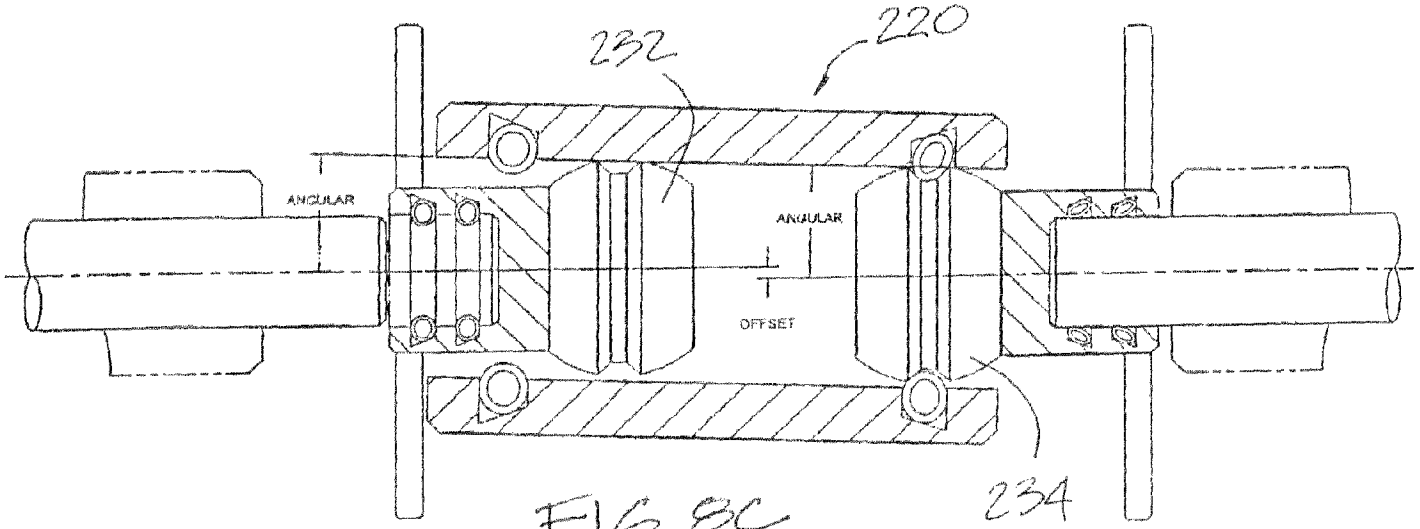
Figure 8D:
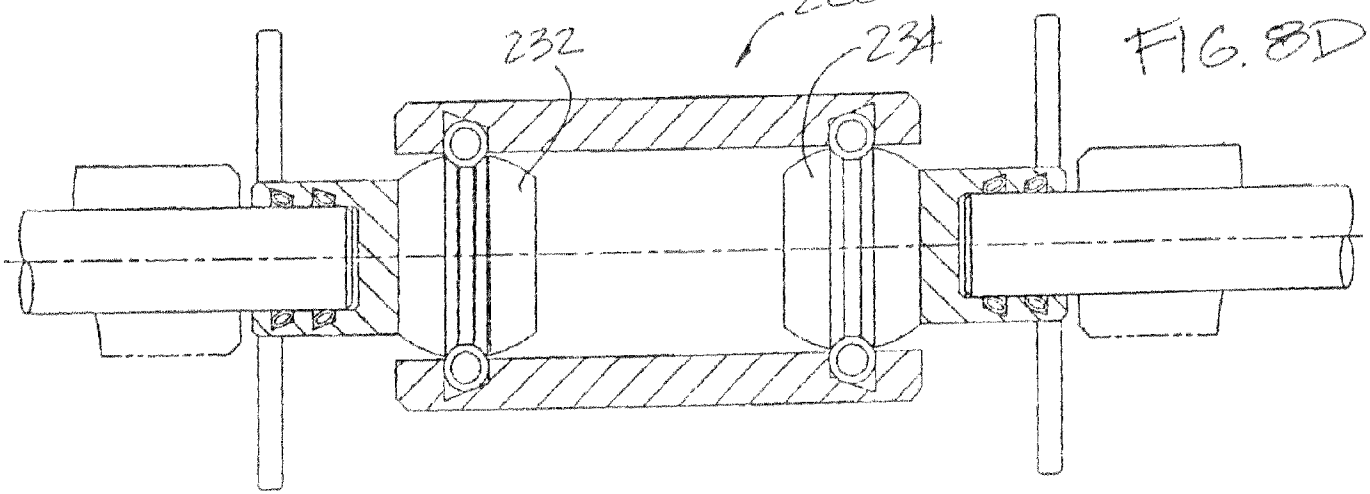
Figure 9A:
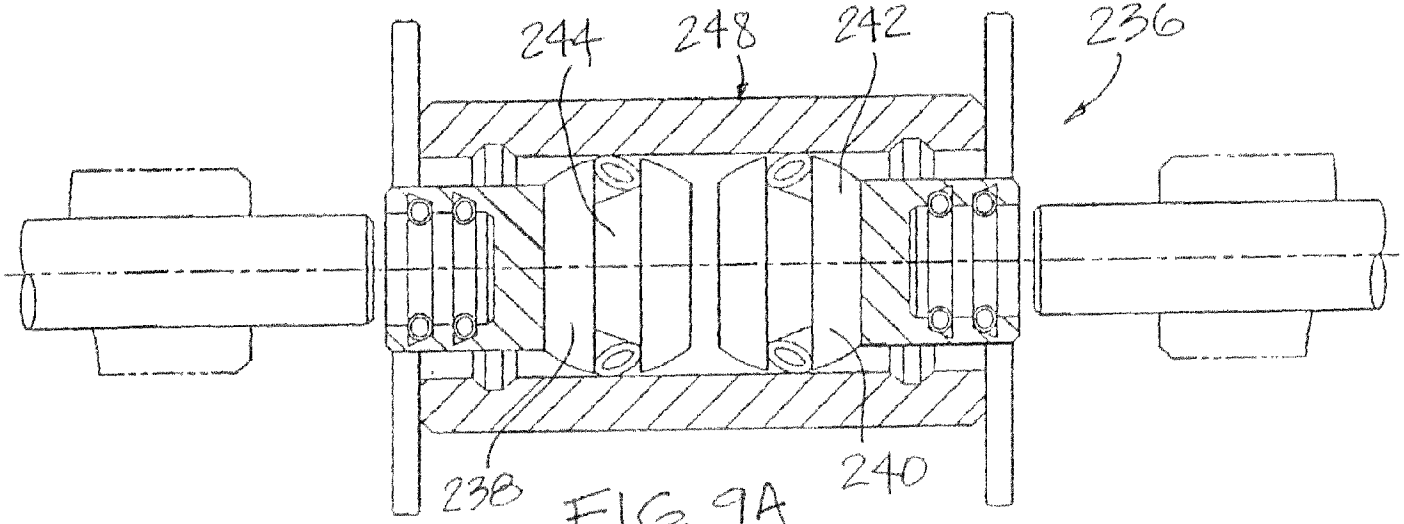
FIGS. 9A, 9B, 9C, and 9D are cross-sectional side views of still another exemplary connector of the present invention during various states of engagement with conductor pins.
Figure 9B:
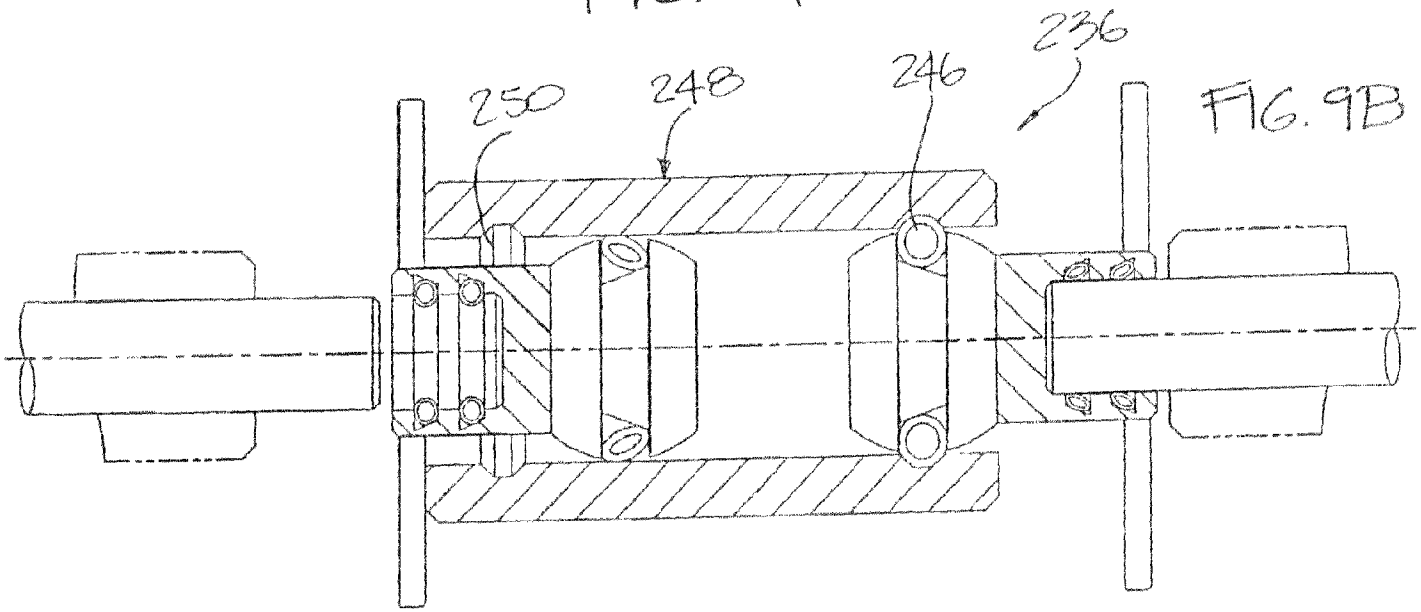
Figure 9C:
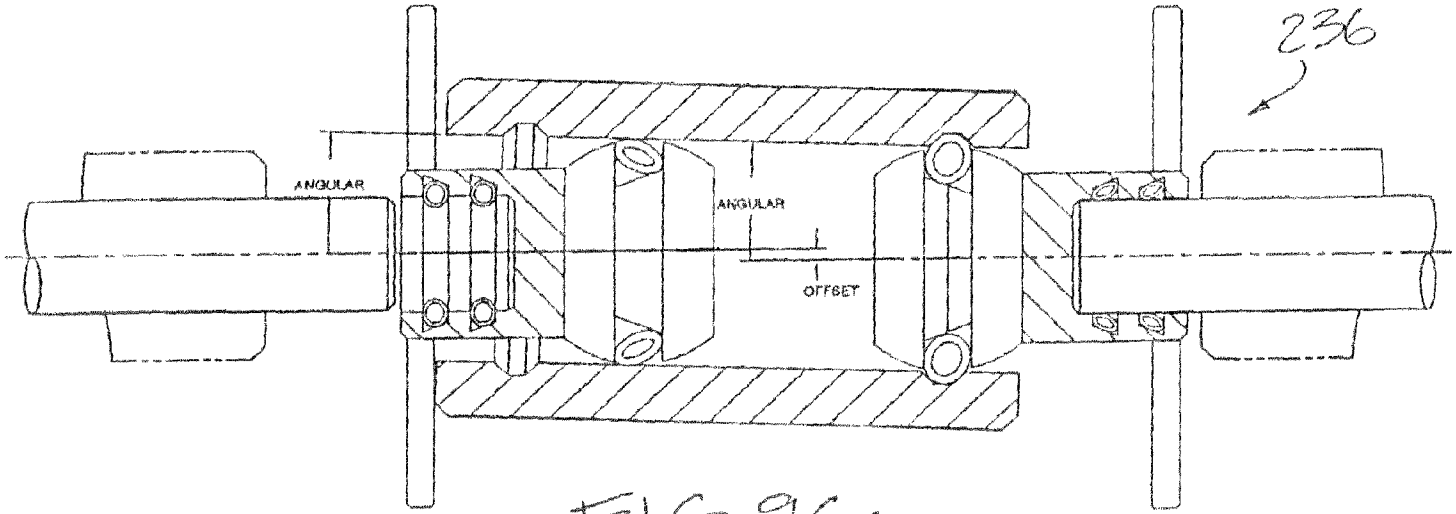
Figure 9D:
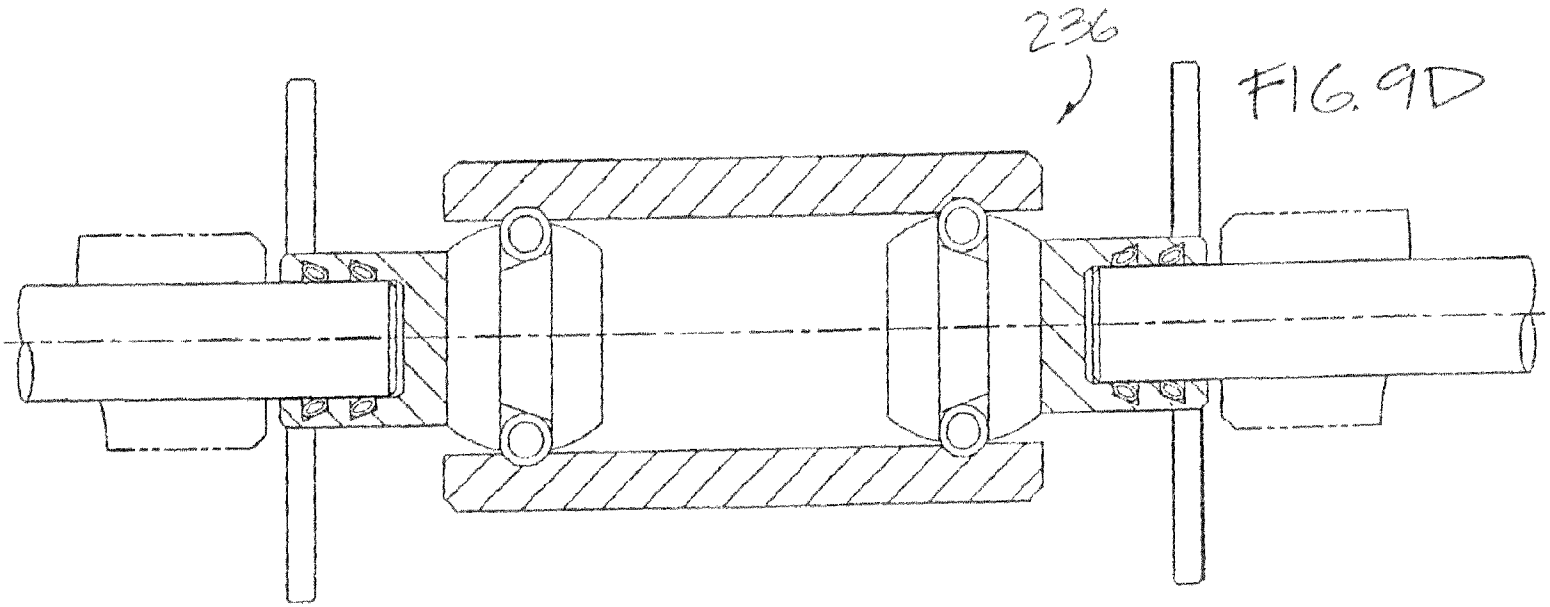

FIGS. 7A, 7B, 7C, and 7D show another exemplary embodiment of an in-line collapsible electrical connector 198 with provisions for accommodating axial and/or radial misalignment and usable without a tool. Similarly to the previously described embodiments, as shown in FIG. 7A, the connector 198 includes two pin connectors 200, 202 slidable within a longitudinal bore of a housing 204, each pin connector is adapted to receive a conductor pin 104, 102. When the conductor pins 102, 104 are inserted into the pin connectors 202, 200, the conductor pins are retained within the pin connectors 202, 200 by canted-coil springs 208, 210, which deflect upon the insertion of the conductor pins (FIGS. 7B and 7C). A base 210 of the pin connectors 200, 202 includes two grooves 212, each groove housing a canted-coil spring 214, 216. The base resembles a barb connector and has at least one tooth having an outer diameter larger than the outer diameter of the collar section. When the pin connectors 200, 202 are moved from a recessed position (FIG. 7A) to an extended position (FIGS. 7B-7D), the canted-coil springs 214, 216 engage grooves 218 in housing 204 which retains the pin connectors in the extended position. As shown in FIG. 7C, the pin connectors 200, 202 may be deflected such that their central axes are offset by about 0.05 inch. With reference to FIG. 7D, when conductor pins 102, 104 are inserted into respective connector pins 202, 200, current flows between the conductor pins. The conductor pins 102, 104 may be disassembled by moving the bases 210 of the pin connectors 200 and 202 together, such as by grasping the two flanges or plates and moving them together.

FIGS. 8A-8D show another exemplary embodiment of an in-line collapsible electrical connector 220 with provisions for accommodating misalignment and/or offset between two conductor pins, similar to the connector 164 shown in FIG. 6. As shown in the figures, canted-coil springs 222 are mounted within bottom taper grooves 224 on a circumferential housing 226. When the canted-coil springs 222 engage a groove 228 on a generally or partially spherical base 230 of connector pins 232, 234, the canted-coil springs retain the connector pins within the circumferential housing 226.

FIGS. 9A-9D show yet another exemplary embodiment of an in-line collapsible electrical connector 236 with provisions for accommodating misalignment and offset between two conductor pins. The configuration is similar to the connector 198 shown in FIG. 7, but connector pins 238, 240 have a partially spherical base 242 with a single groove 244 containing a canted-coil spring 246. Such a configuration allows greater angular misalignment while allowing sufficient area of contact between the canted coil spring 246 and a circumferential housing 248 for the spring to carry electrical current through the connector 236. Similar to previously described embodiments, when the canted-coil spring 246 engages a groove 250 on the interior of the housing 248, the connector pins 236, 240 can be maintained within the housing.

Axial canted-coil springs generally develop greater concentrated loads at the points of contact than radial canted-coil springs, thereby reducing or eliminating the possibility of oxidation at such contact points, thus maintaining constant conductivity. The higher the stress concentration, the greater the degree of conductivity. Thus, in certain embodiments, the canted coil springs utilized are preferably axial canted coil springs.

Threaded connectors, when subject to thermal variations, typically have reduced torque for maintaining the connection. Such torque reduction may be accelerated by wide variations in temperature, and particularly by the variation in thermal expansion of the fastener holding the components together. The use of canted springs as a conductor as well as a holding, latching and locking means overcomes the thermal expansion problem due to the degree of flexibility available with such springs. Holding, latching and locking of the spring groove and spring itself can be made to any desired retained force based on spring force and groove configuration.

Although the preferred embodiments of the invention have been described with some specificity, the description and drawings set forth herein are not intended to be limiting, and persons of ordinary skill in the art will understand that various modifications may be made to the embodiments discussed herein without departing from the scope of the invention, and all such changes and modifications are intended to be encompassed within the appended claims. Various changes to the connecter may be made, such as varying the number and configuration of grooves and canted-coil springs within the housing and within the connecting pins, and varying the depth and width of the grooves and springs. Furthermore, while the housing, the springs, and housing pins are said to made from a conductive material to enable electrical communication between two conductive members, the particular material types are not limited in anyway and may be made from any known conductive materials in the electrical art, such as from aluminum, metal, gold, etc. Additionally, specific aspects of one embodiment may be incorporated in a different embodiment provided they are compatible.

What is claimed:

1. An electrical connector for providing electrical communication between two in-line conductive members comprising:

a housing comprising an outer sleeve defining a sleeve longitudinal bore including a first bore section having a first diameter and a second bore section having a second diameter; and a retaining cylinder slidable within the first bore section of the outer sleeve, the first bore section and the second bore section each having at least one groove formed along an inner circumferential surface and containing a canted-coil spring;

wherein the retaining cylinder defines a cylinder longitudinal bore coaxial with the sleeve longitudinal bore and having at least one groove formed along an inner circumferential surface and containing a canted-coil spring, the cylinder longitudinal bore adapted to receive a conductor pin.

2. The in-line electrical connector of claim 1, further comprising a retaining groove around an outer circumferential surface of the retaining cylinder adapted to engage the canted-coil spring in the first bore section of the outer sleeve.

3. The in-line electrical connector of claim 1, wherein the retaining cylinder comprises an extended position in which a substantial part of the retaining cylinder is disposed outside of the longitudinal bore of the outer sleeve and a retracted position in which a substantial part of the retaining cylinder is disposed inside the longitudinal bore of the outer sleeve.

4. The in-line electrical connector of claim 3, wherein retaining cylinder engages the canted coil spring in the first bore section of the outer sleeve when in the extended position.

5. The in-line electrical connector of claim 1, further comprising a second retaining cylinder slidable within the second bore section with respect to the outer sleeve.

6. The in-line electrical connector of claim 5, wherein the second retaining cylinder comprises a groove formed on an exterior surface and a groove formed on an interior surface and having a canted coil spring positioned in the groove of the interior surface.

7. An electrical connector for connecting two in-line conductive members comprising:

a housing defining a longitudinal bore and made from a conductive material; and two retaining cylinders slidable within the longitudinal bore, each retaining cylinder including a base having a base outer diameter, and a collar comprising an outer collar diameter and a bore with at least one canted-coil spring located within an inner circumferential groove of the bore, the collar dimensioned to receive a conductor pin, and wherein the base diameter is larger than the collar diameter.

8. The electrical connector of claim 7, wherein a canted coil spring is captured between the base and the longitudinal bore of the housing for at least one of the two retaining cylinders when said retaining cylinder is in an extended position.

9. The electrical connector of claim 8, further comprising a groove formed on at least one of the base and the longitudinal bore of the housing to capture the canted coil spring in the extended position.

10. The electrical connector of claim 8, wherein a canted coil spring is captured between the base and the longitudinal bore of the other one of the two retaining cylinders when said retaining cylinder is in an extended position.

11. The electrical connector of claim 7, wherein the base of at least one of the two retaining cylinders has a partial spherical configuration.

12. The electrical connector of claim 11, wherein the base has a groove formed thereon.

13. The electrical connector of claim 7, wherein the base of at least one of the two retaining cylinders has a barb configuration with a groove formed thereon.

14. The electrical connector of claim 7, wherein the longitudinal bore of the housing has a plurality of housing grooves formed thereon.

15. The electrical connector of claim 7, further comprising a stopping flange located on the collar of each of the two retaining cylinders.

16. A method for electrical contact between two conductor pins comprising:

pushing an end of a first conductor pin into a first bore, said first bore comprising at least one canted-coil spring;

pushing an end of a second conductor pin into a second bore, said second bore comprising at least one canted coil spring;

sliding a conductor housing and at least one of the first conductor pin and the second conductor pin relative to one another or sliding a retaining cylinder located inside the conductor housing and the conduct housing relative to one another to a housing contact position; and wherein the conductor housing is positioned at an over-inserted position relative to the first conductor pin or the second conductor pin before the relative sliding step to move the conductor housing to the housing contact position or is positioned at an over-inserted position relative to the retaining cylinder before the relative sliding step to move the conductor housing to the housing contact position.

17. The method of claim 16, further comprising moving at least one of the conductor housing and a second sleeve relative to one another.

18. The method of claim 16, wherein the first bore is located inside a collar of the retaining cylinder.

19. The method of claim 18, wherein the second bore is located inside a collar of a second retaining cylinder.

20. The method of claim 18, wherein the retaining cylinder comprises a base having a partial spherical section.

* * * * *

UNITED STATES PATENT AND TRADEMARK OFFICE

CERTIFICATE OF CORRECTION

PATENT NO. : 7,722,415 B2
APPLICATION NO. : 12/329870
DATED : May 25, 2010
INVENTOR(S) : Derek Changsrivong It is certified that error appears in the above-identified patent and that said Letters Patent is hereby corrected as shown below:

On the title page, item (75), Inventor, in column 1, line 1, delete "Chansrivong," and insert -- Changsrivong, --, therefor..

In column 2, line 37, delete "7,055,812, B2," and insert -- 7,055,812 B2, --, therefor.

In column 7, line 35, after "member" delete "fiber".

In column 11, line 2, delete "122" and insert -- 132 --, therefor.

Signed and Sealed this

Sixteenth Day of November, 2010

David J. Kappos

David J. Kappos
*Director of the United States Patent and Trademark Office*